US010632706B2

(12) United States Patent
Makita et al.

(10) Patent No.: US 10,632,706 B2
(45) Date of Patent: Apr. 28, 2020

(54) BINDING MEMBER AND BINDING DEVICE

(71) Applicant: FUJI XEROX CO., LTD., Tokyo (JP)

(72) Inventors: Takuya Makita, Yokohama (JP); Hiroaki Awano, Yokohama (JP); Kojiro Tsutsumi, Yokohama (JP); Toshiyasu Yukawa, Yokohama (JP); Katsumi Harada, Yokohama (JP); Takashi Ogino, Ebina (JP); Masashi Matsumoto, Yokohama (JP); Yutaka Nobe, Yokohama (JP); Satoshi Kurihara, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/026,850

(22) Filed: Jul. 3, 2018

(65) Prior Publication Data

US 2019/0077108 A1 Mar. 14, 2019

(30) Foreign Application Priority Data

Sep. 12, 2017 (JP) ..... 2017-174968
Sep. 20, 2017 (JP) ..... 2017-179860

(51) Int. Cl.

| | |
|---|---|
| ***B31F 5/02*** | (2006.01) |
| ***G03G 15/00*** | (2006.01) |
| ***B42C 1/12*** | (2006.01) |
| ***B65H 37/04*** | (2006.01) |
| ***B42B 5/00*** | (2006.01) |

(52) U.S. Cl.

CPC ..... *B31F 5/02* (2013.01); *B31F 5/022* (2013.01); *B42B 5/00* (2013.01); *B42C 1/12* (2013.01); *B65H 37/04* (2013.01); *G03G 15/6544* (2013.01); *B65H 2301/43828* (2013.01); *B65H 2301/51616* (2013.01); *B65H 2801/27* (2013.01)

(58) Field of Classification Search

CPC .. B31F 5/02; B42C 1/12; B65H 37/04; B65H 2301/43828; B65H 2301/51616; B65H 2801/27; G03G 15/6544

USPC ..... 270/58.08

See application file for complete search history.

(56) References Cited

U.S. PATENT DOCUMENTS 8,845,258 B2 * 9/2014 Mori ..... B42B 5/00 412/33
9,315,356 B2 * 4/2016 Yoshida ..... G03G 15/6544
(Continued)

FOREIGN PATENT DOCUMENTS

JP 2010-274623 A 12/2010
JP 2011-201654 A 10/2011
(Continued)

*Primary Examiner* — Leslie A Nicholson, III
(74) *Attorney, Agent, or Firm* — Sughrue Mion, PLLC

(57) ABSTRACT

A binding member includes: an upper tooth that has an upper tooth form for forming unevenness in a bundle of recording materials; and a lower tooth that has a lower tooth form for forming unevenness in the bundle of recording materials and that forms a pair with the upper tooth. At least one of the upper tooth form and the lower tooth form is formed such that, in a sectional shape, a groove is formed in a trough portion of a concave portion of a tooth form and a length of an inclined portion which comes into contact with the bundle of recording materials is made small compared to a case where the inclined portion of the tooth form has reached a bottom of the trough portion.

11 Claims, 15 Drawing Sheets

(56) References Cited

U.S. PATENT DOCUMENTS

| | | | | |
|---|---|---|---|---|
| 9,744,740 | B2 * | 8/2017 | Abe | G03G 15/6544 |
| 9,809,000 | B2 * | 11/2017 | Kubo | B42B 5/00 |
| 10,046,535 | B2 * | 8/2018 | Nakano | B31F 5/02 |
| 10,093,071 | B2 * | 10/2018 | Makita | B65H 37/04 |
| 10,357,932 | B2 * | 7/2019 | Awano | B31F 5/02 |
| 2014/0161565 | A1 | 6/2014 | Obuchi et al. | |
| 2014/0219747 | A1 | 8/2014 | Takahashi et al. | |
| 2015/0076759 | A1 * | 3/2015 | Kosuge | B42F 1/00 270/1.01 |
| 2016/0193802 | A1 | 7/2016 | Obuchi et al. | |
| 2017/0282482 | A1 * | 10/2017 | Awano | B31F 5/02 |
| 2017/0283207 | A1 * | 10/2017 | Makita | B65H 37/04 |
| 2018/0015768 | A1 | 1/2018 | Nobe et al. | |
| 2018/0015769 | A1 | 1/2018 | Nobe et al. | |
| 2018/0016110 | A1 | 1/2018 | Nobe et al. | |
| 2018/0017927 | A1 | 1/2018 | Nobe et al. | |
| 2018/0370177 | A1 * | 12/2018 | Awano | B31F 5/02 |

FOREIGN PATENT DOCUMENTS

| | | | |
|---|---|---|---|
| JP | 2014-114113 | A | 6/2014 |
| JP | 2014-148398 | A | 8/2014 |
| JP | 6108014 | B1 | 4/2017 |

* cited by examiner

BINDING MEMBER AND BINDING DEVICE

CROSS-REFERENCE TO RELATED APPLICATIONS

This application is based on and claims priorities under 35 USC 119 from Japanese Patent Application No. 2017-179860 filed on Sep. 20, 2017, and Japanese Patent Application No. 2017-174968 filed on Sep. 12, 2017.

BACKGROUND

Technical Field

The present invention relates to a binding member and a binding device.

SUMMARY

According to an aspect of the invention, there is provided a binding member including: an upper tooth that has an upper tooth form for forming unevenness in a bundle of recording materials; and a lower tooth that has a lower tooth form for forming unevenness in the bundle of recording materials and that forms a pair with the upper tooth. At least one of the upper tooth form and the lower tooth form is formed such that, in a sectional shape, a groove is formed in a trough portion of a concave portion of a tooth form and a length of an inclined portion which comes into contact with the bundle of recording materials is made small compared to a case where the inclined portion of the tooth form has reached a bottom of the trough portion.

BRIEF DESCRIPTION OF DRAWINGS

Exemplary embodiment(s) of the present invention will be described in detail based on the following figures, wherein.

DETAILED DESCRIPTION

Hereinafter, an exemplary embodiment of the invention will be described with reference to accompanying drawings.

Figure 1:
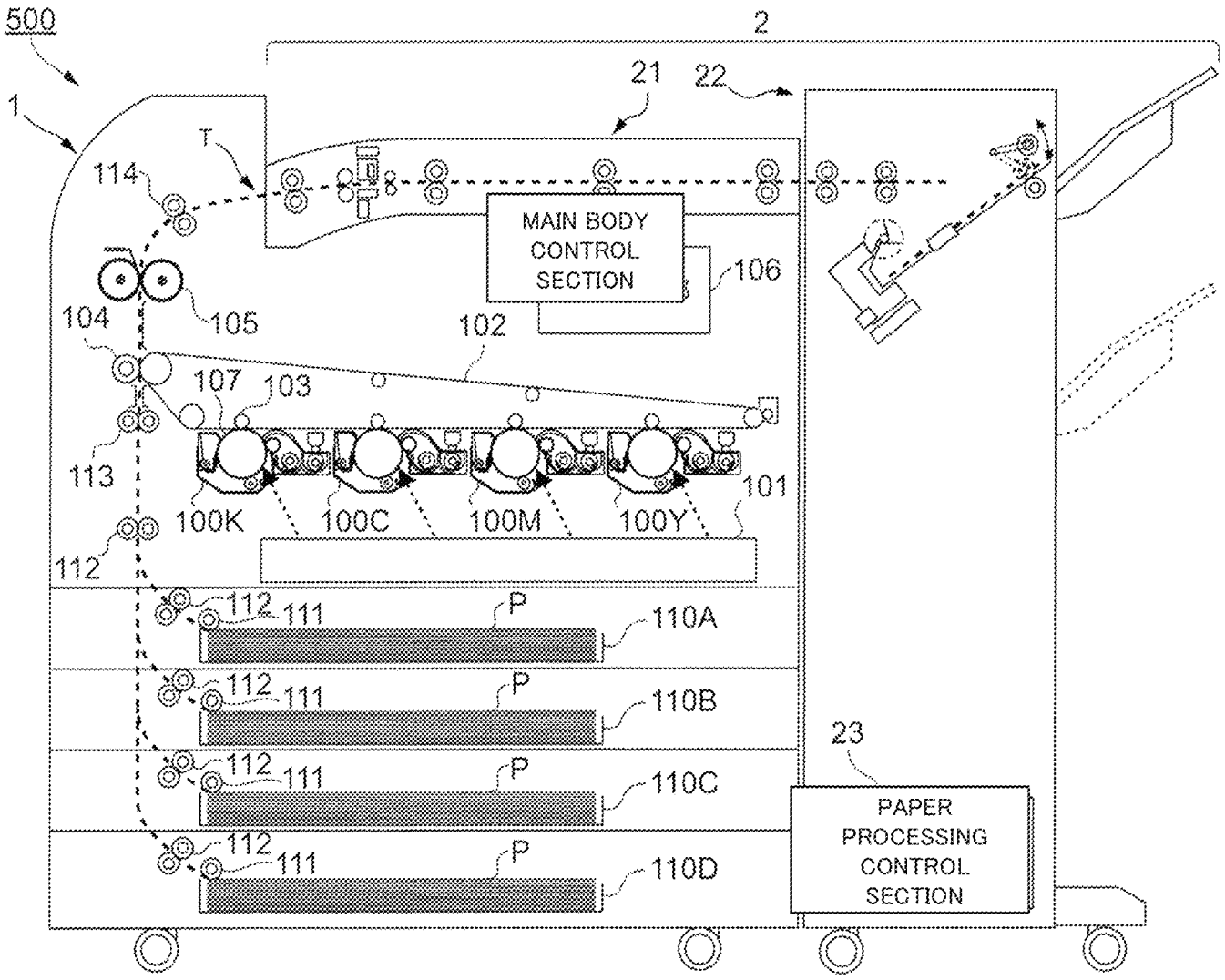
FIG. 1 illustrates a configuration of an image forming system.

FIG. 1 illustrates a configuration of an image forming system 500 to which the exemplary embodiment is applied.

The image forming system 500 illustrated in FIG. 1 includes an image forming apparatus 1 such as a printer and a copier that forms a color image onto paper P, which is an example of a recording material, and a post-processing apparatus 2 that performs binding processing with respect to the sheets of paper P (a bundle of recording materials) on which an image is formed by the image forming apparatus 1.

The image forming apparatus 1 is provided with four image forming units 100Y, 100M, 100C, and 100K (collectively referred to as "image forming units 100"), which are examples of image forming portions. The four image forming units 100Y, 100M, 100C, and 100K form an image based on image data in each color.

The image forming apparatus 1 is provided with a laser exposure device 101 that exposes photoconductor drums 107 provided in the respective image forming units 100. The image forming apparatus 1 is provided with an intermediate transfer belt 102 on which a toner image in each color formed by each of the image forming units 100 is multiply transferred.

The image forming apparatus 1 is provided with primary transfer rolls 103 that transfer (primary transfer) a toner image in each color, which is formed by each of the image forming units 100, onto the intermediate transfer belt 102 in turn, a secondary transfer roll 104 that transfers (secondary transfer) the toner image in each color, which is transferred on the intermediate transfer belt 102, at once onto the paper P, and a fixing device 105 that fixes the secondarily transferred toner image in each color onto the paper P. The image forming apparatus 1 is provided with a main body control section 106, which is configured of a program-controlled CPU and controls the operation of the image forming apparatus 1.

In each image forming unit 100 of the image forming apparatus 1, a toner image in each color is formed via a process of charging the photoconductor drum 107, a process of the laser exposure device 101 performing scanning-exposure to form an electrostatic latent image onto the photoconductor drum 107, and a process of developing a toner in each color onto the formed electrostatic latent image.

The toner image in each color, which is formed by each of the image forming units 100, is electrostatically transferred in turn onto the intermediate transfer belt 102 by each of the primary transfer rolls 103. As the intermediate transfer belt 102 moves, the toner image in each color is transported to a position where the secondary transfer roll 104 is provided.

In the image forming apparatus 1, different sizes or different types of the sheets of paper P are accommodated in respective paper accommodating units 110A to 110D.

When forming an image onto the paper P, for example, the paper P is picked up from the paper accommodating unit 110A by a pickup roll 111, and is transported one by one to the position of a resist roll 113 by a transport roller 112.

The paper P is supplied from the resist roll 113 in accordance with a timing when the toner image in each color on the intermediate transfer belt 102 is transported to a position where the secondary transfer roll 104 is disposed.

Accordingly, the toner image in each color is electrostatically transferred (secondary transfer) onto the paper P at once by the action of a transfer electric field formed by the secondary transfer roll 104.

After then, the paper P, on which the toner image in each color is secondarily transferred, is separated from the intermediate transfer belt 102 and is transported to the fixing device 105. In the fixing device 105, the toner image in each color is fixed onto the paper P by fixing processing by heat and a pressure.

Then, the paper P passed through the fixing device 105 is output from a paper outputting portion T of the image forming apparatus 1 by a transport roller 114 and is supplied to the post-processing apparatus 2.

The post-processing apparatus 2, which is an example of a recording material processing apparatus, is disposed on a downstream side of the paper outputting portion T of the image forming apparatus 1, and performs post-processing such as punching and binding with respect to the paper P on which an image is formed.

Figure 2:
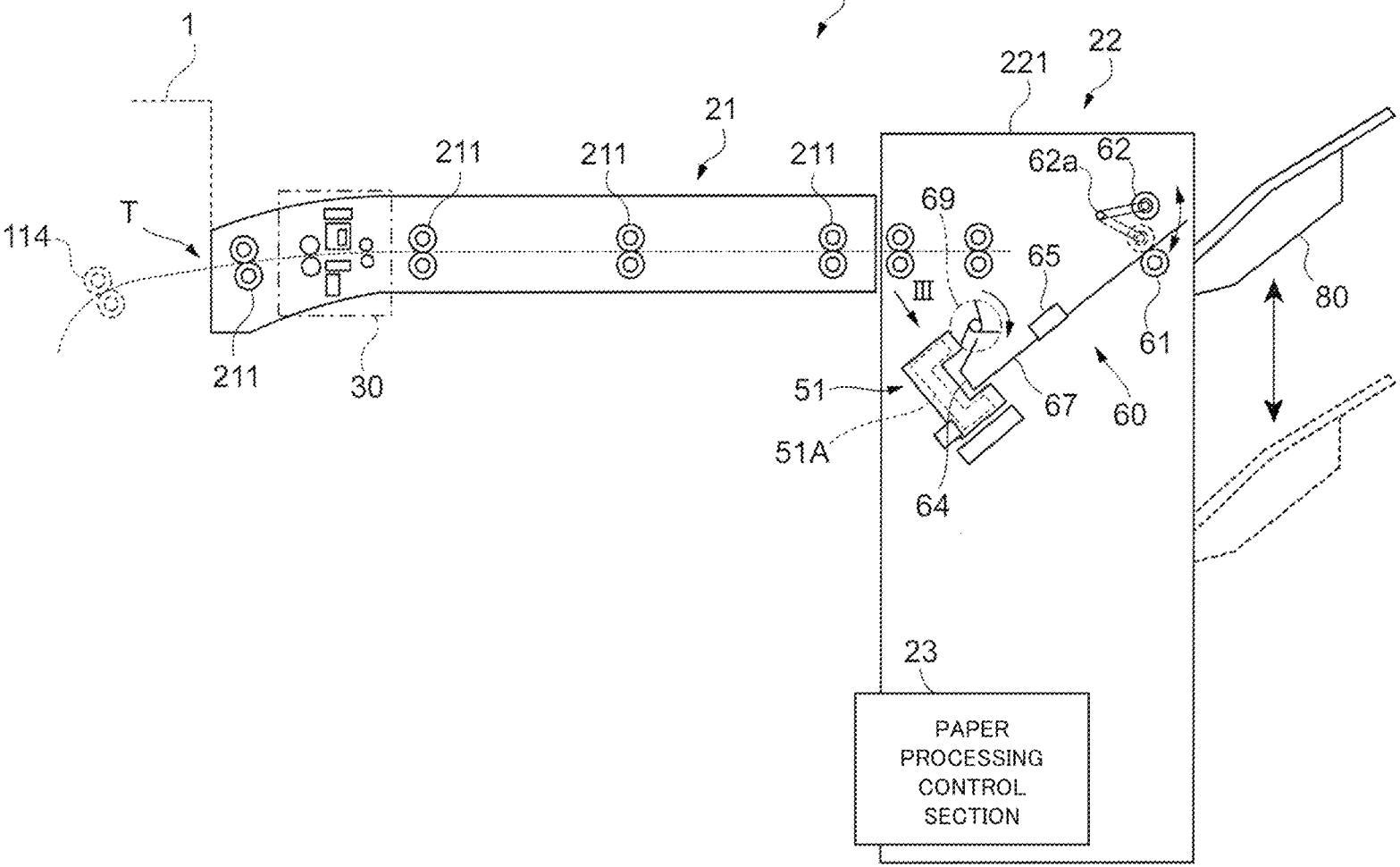
FIG. 2 illustrates a configuration of a post-processing apparatus.

FIG. 2 illustrates a configuration of the post-processing apparatus 2.

The post-processing apparatus 2 is provided with a transport unit 21 connected to the paper outputting portion T of the image forming apparatus 1 and a finisher unit 22 that carries out processing determined in advance with respect to the paper P transported by the transport unit 21.

The post-processing apparatus 2 is provided with a paper processing control section 23, which is configured of a program-controlled CPU and controls each mechanism unit of the post-processing apparatus 2. The paper processing control section 23 is connected to the main body control section 106 (refer to FIG. 1) by a signal line (not illustrated), and transmits and receives a control signal to and from the main body control section.

The transport unit 21 of the post-processing apparatus 2 is provided with a punching unit 30 that carries out punching of two holes or four holes.

In addition, the transport unit 21 is provided with transport rollers 211 that function as a transporting unit. The transport rollers 211 transport the paper P, on which an image is formed by the image forming apparatus 1, to the finisher unit 22.

The finisher unit 22 is provided with a finisher unit main body 221, a paper collecting unit 60 that collects a necessary number of sheets of the paper P to create a bundle of paper, which an example of a bundle of recording materials, and a binding unit 51 that executes binding (end binding) with respect to an end portion of a bundle of paper created by the paper collecting unit 60.

The finisher unit 22 is provided with a transport roller 61 which is rotatably provided and is used in transporting a bundle of paper created by the paper collecting unit 60. In addition, a movable roller 62 that is provided so as to be swingable about a rotation shaft 62*a*, which is a movement center, and is movable to a position of retracting from the transport roller 61 and a position of coming into press-contact with the transport roller 61.

In addition, a stacker 80, on which a bundle of paper transported by the transport roller 61 and the movable roller 62 is stacked, is provided. The stacker 80 moves up and down according to the amount of a bundle of paper which is being held.

When processing is performed by the post-processing apparatus 2, first, the paper P is brought into the transport unit 21 of the post-processing apparatus 2 from the image forming apparatus 1.

After the punching unit 30 performs punching, the paper P is sent to the finisher unit 22 by the transport rollers 211, in the transport unit 21.

In a case where there is no instruction of punching, the paper P is sent to the finisher unit 22 as it is without punching processing being performed by the punching unit 30.

The paper P sent to the finisher unit 22 is transported to the paper collecting unit 60. Specifically, the paper P falls to the paper collecting unit 60 after being transported to the upper side of the paper collecting unit 60.

Then, the paper P is supported from below by a supporting plate 67 provided in the paper collecting unit 60. Inclination imparted to the supporting plate 67 and a rotating paddle 69 allow the paper P to slidingly move on the supporting plate 67.

After then, the paper P abuts against an end guide 64 mounted on an end portion of the supporting plate 67. Accordingly, in the exemplary embodiment, the movement of the paper P is stopped.

Subsequently, this operation is performed each time the paper P is transported from an upstream side, and a bundle of paper (a bundle of recording materials), which is in a state where a trailing end portion of the paper P is aligned, is created on the paper collecting unit 60.

In the exemplary embodiment, aligning members 65 that are provided so as to be movable in a width direction of a bundle of paper (provided so as to be movable in a direction orthogonal to the page of FIG. 2) and align the position of the bundle of paper in the width direction are provided.

Two aligning members 65 are provided. One aligning member 65 is disposed on one end side in the width direction of a bundle of paper, and the other aligning member 65 is disposed on the other end side in the width direction of a bundle of paper.

In the exemplary embodiment, end portions (side portions) of the paper P in the width direction are pressed by the aligning members 65 each time the paper P is supplied onto the supporting plate 67, and the position of the paper P (a bundle of paper) in the width direction is aligned.

When a predetermined number of sheets of the paper P are stacked on the supporting plate 67 and a bundle of paper is created on the supporting plate 67, the binding unit 51 executes binding processing with respect to an end portion of the bundle of paper.

The binding unit 51 is provided with a binding member (a pair of teeth) (to be described later) that presses a bundle of paper. The binding member is configured with upper teeth disposed on the upper side of a bundle of paper to be created and lower teeth disposed on the lower side of the bundle of paper to be created.

In the exemplary embodiment, an advancing/retracting mechanism 51A that causes one side of a row of the upper teeth or the lower teeth to advance/retract with respect to the other side is provided.

In the exemplary embodiment, when a bundle of paper is created on the supporting plate 67, this bundle of paper is positioned between the upper teeth and the lower teeth. After then, the bundle of paper is pressed by the upper teeth and the lower teeth from both surface of the bundle of paper, and the sheets of paper configuring the bundle of paper is compressed, thereby performing binding processing of the bundle of paper.

In other words, in the exemplary embodiment, binding processing is performed with respect to a bundle of paper without using a needle such as a stapling needle. That is, in the exemplary embodiment, binding processing is performed without a needle.

When binding processing with respect to the bundle of paper is terminated, the movable roller 62 advances toward the transport roller 61, and the bundle of paper is sandwiched between the movable roller 62 and the transport roller 61.

After then, the transport roller 61 and the movable roller 62 are rotationally driven, and thus the binding-processed bundle of paper is transported to the stacker 80.

Figure 3:
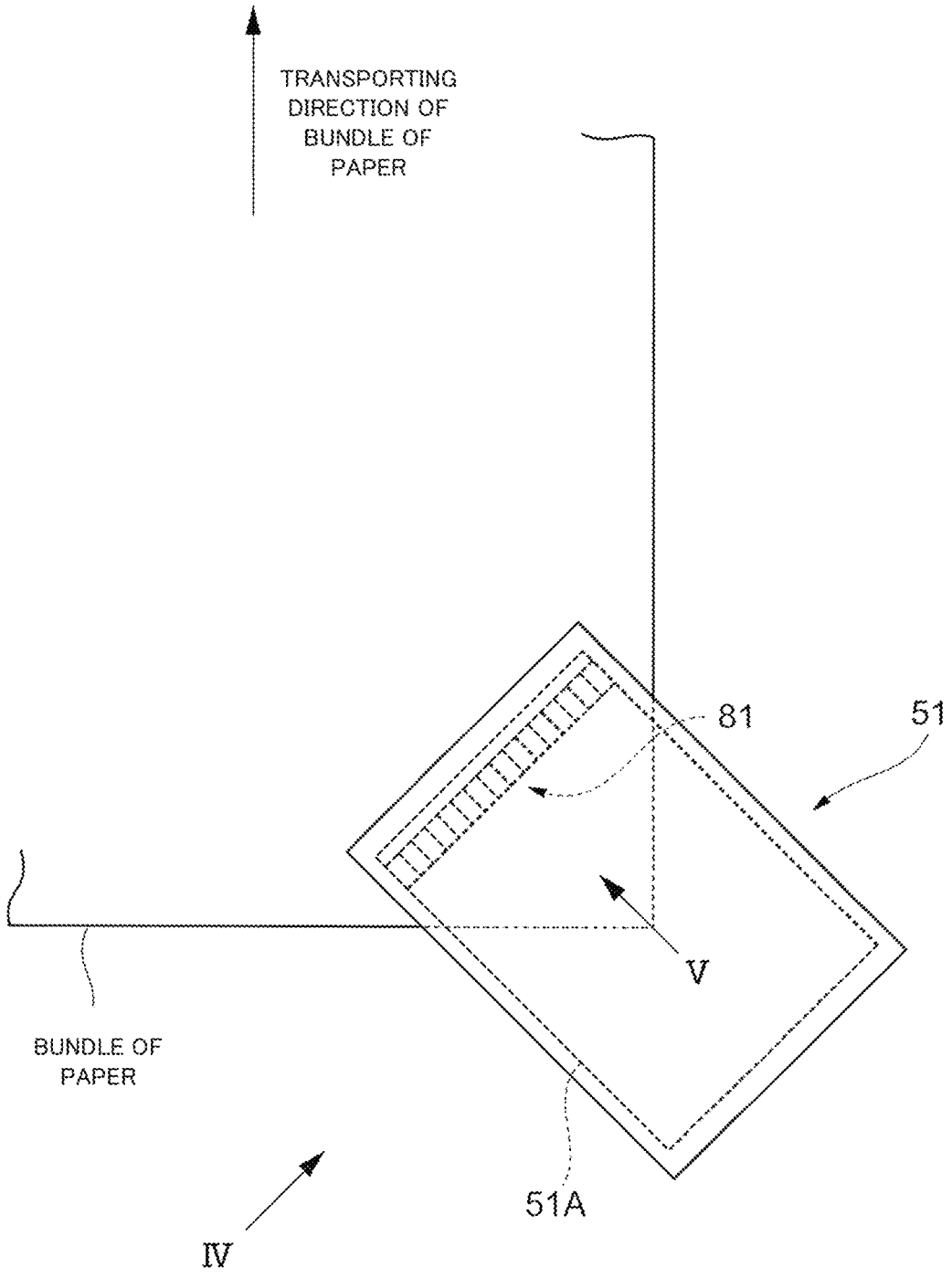
FIG. 3 illustrates a binding unit viewed from an arrow III direction of FIG. 2.

FIG. 3 illustrates the binding unit 51 viewed from an arrow 111 direction of FIG. 2.

In the exemplary embodiment, as illustrated in FIG. 3, the binding unit 51 is disposed in a state of being inclined with respect to a transporting direction of a bundle of paper. The binding unit 51 is provided with a binding member 81. In the exemplary embodiment, the binding member 81 performs binding processing of a bundle of paper with the bundle of paper being sandwiched.

In addition, the binding unit 51 is disposed so as to be opposed to a corner of the bundle of paper, and performs binding processing of the corner of the bundle of paper.

Although a case where the binding unit 51 is disposed so as to be opposed to a corner of a bundle of paper is given as an example in the exemplary embodiment, the binding unit 51 may be disposed so as to be opposed to a side of a bundle of paper. In addition, the binding unit 51 may be movably provided to perform binding processing at portions of a bundle of paper.

Figure 4A:
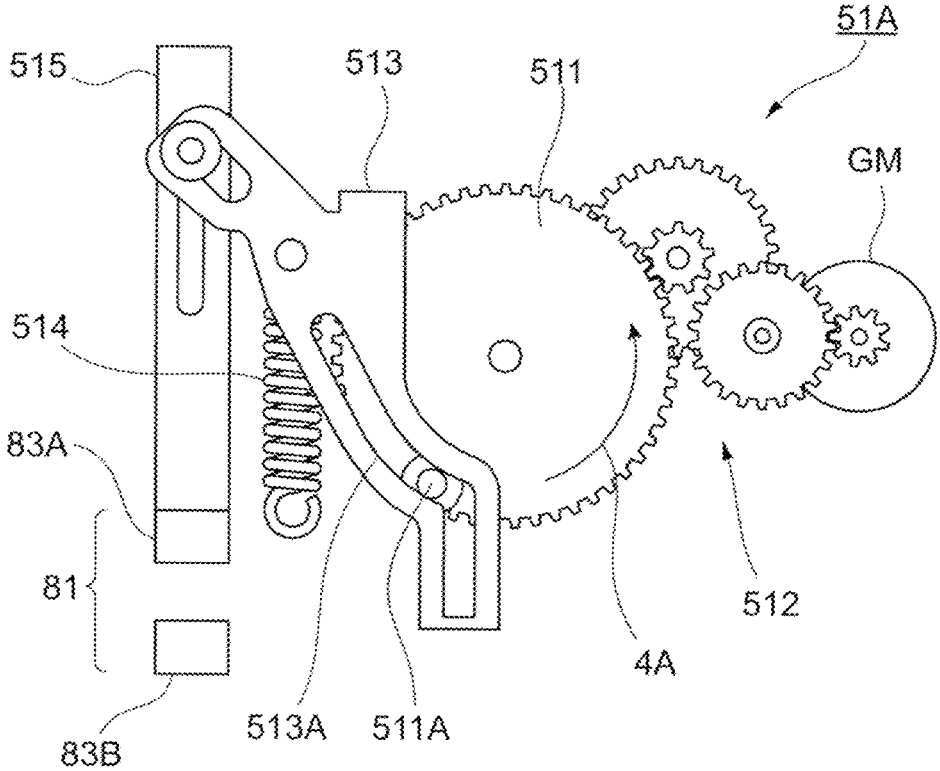
FIGS. 4A and 4B illustrate an advancing/retracting mechanism viewed from an arrow IV direction of FIG. 3.
Figure 4B:
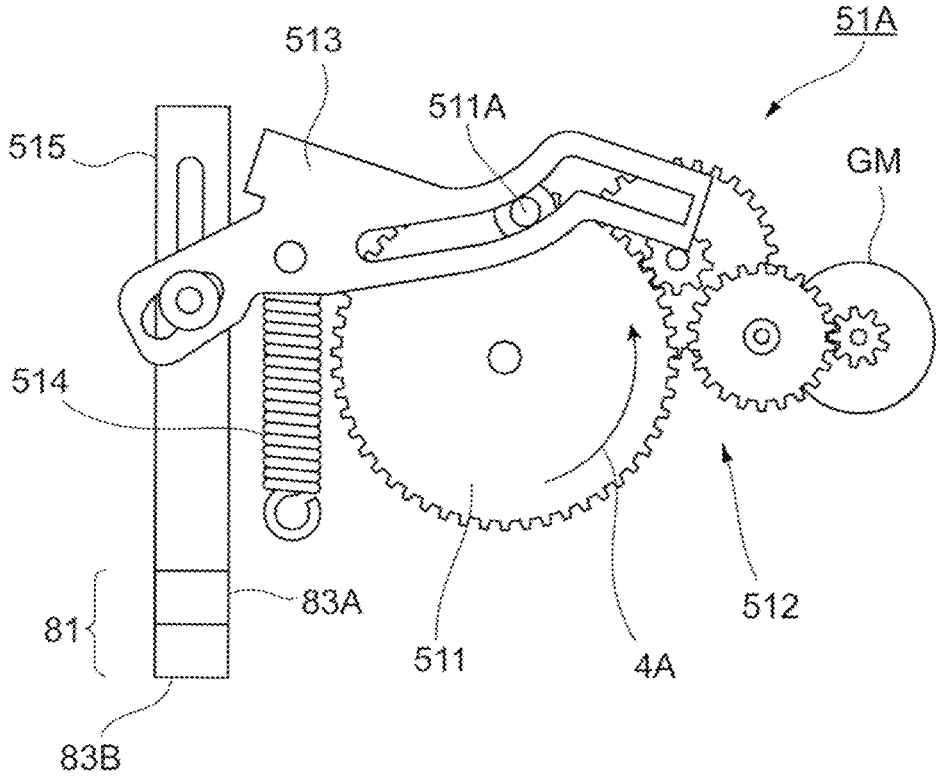

FIGS. 4A and 4B illustrate the advancing/retracting mechanism 51A viewed from an arrow IV direction of FIG. 3.

As illustrated in FIG. 4A, in the exemplary embodiment, the binding member 81, which is driven by the advancing/retracting mechanism 51A and presses a bundle of paper, is provided.

The binding member 81 is configured with upper teeth 83A and lower teeth 83B disposed at opposite positions to the upper teeth 83A. In the exemplary embodiment, the upper teeth 83A are disposed on the upper side and the lower teeth 83B are disposed on the lower side.

As illustrated in FIG. 4A, the advancing/retracting mechanism 51A is provided with a rotation gear 511. A motor for a gear GM that rotates the rotation gear 511 and a transmission gear 512 that transmits a rotational driving force from the motor for a gear GM to the rotation gear 511 are provided. A protruding portion 511A is provided on a side surface of the rotation gear 511.

The advancing/retracting mechanism 51A is provided with a crank member 513 that makes a swinging motion. A long hole 513A is formed in the crank member 513, and the protruding portion 511A of the rotation gear 511 is positioned in this long hole 513A.

A spring 514 that biases the crank member 513 downwards is provided. In addition, an advancing/retracting member 515 that is mounted on a left end portion of the crank member 513 in FIG. 4A and advances/retracts in an up-and-down direction is provided. In the exemplary embodiment, the upper teeth 83A are mounted on a lower end portion of the advancing/retracting member 515.

FIG. 4A illustrates a state where the advancing/retracting member 515 has moved upwards and the upper teeth 83A have retracted from the lower teeth 83B.

When binding processing is performed, the motor for a gear GM is driven, the rotation gear 511 rotates in a direction illustrated with an arrow 4A of FIG. 4A, and the rotation gear 511 is brought into a state of FIG. 4B.

In the state illustrated in FIG. 4B, the protruding portion 511A of the rotation gear 511 is positioned upwards and a right end portion of the crank member 513 in FIG. 4B is lifted upwards.

The spring 514 pulls the crank member 513 downwards and the advancing/retracting member 515 moves downwards.

Accordingly, the upper teeth 83A are pressed against a bundle of paper from one side of the bundle of paper (not illustrated in FIG. 4). In addition, the lower teeth 83B are pressed against the bundle of paper from the other side of the bundle of paper.

Accordingly, the bundle of paper is sandwiched between the upper teeth 83A and the lower teeth 83B, and paper configuring the bundle of paper is compressed. After then, in the exemplary embodiment, the upper teeth 83A are separated away from the bundle of paper. Accordingly, the binding-processed bundle of paper P is picked up from between the upper teeth 83A and the lower teeth 83B.

As described above, in the exemplary embodiment, binding processing is performed with respect to a bundle of paper by moving the upper teeth 83A in the up-and-down direction, which is an advancing/retracting direction determined in advance.

Although the upper teeth 83A are moved by using the crank member 513 in the exemplary embodiment, this is merely an example. A non-circular cam may be pressed against a portion moving in tandem with the upper teeth 83A or the upper teeth 83A to move the upper teeth 83A. In other words, the movement of the upper teeth 83A are not limited to the mechanism illustrated in FIG. 4, and may be made by another known mechanism.

In addition, although the upper teeth 83A are caused to advance/retract with respect to the lower teeth 83B in the exemplary embodiment, the lower teeth 83B may be caused to advance/retract, or both of the upper teeth 83A and the lower teeth 83B may be caused to advance/retract.

Figure 5A:
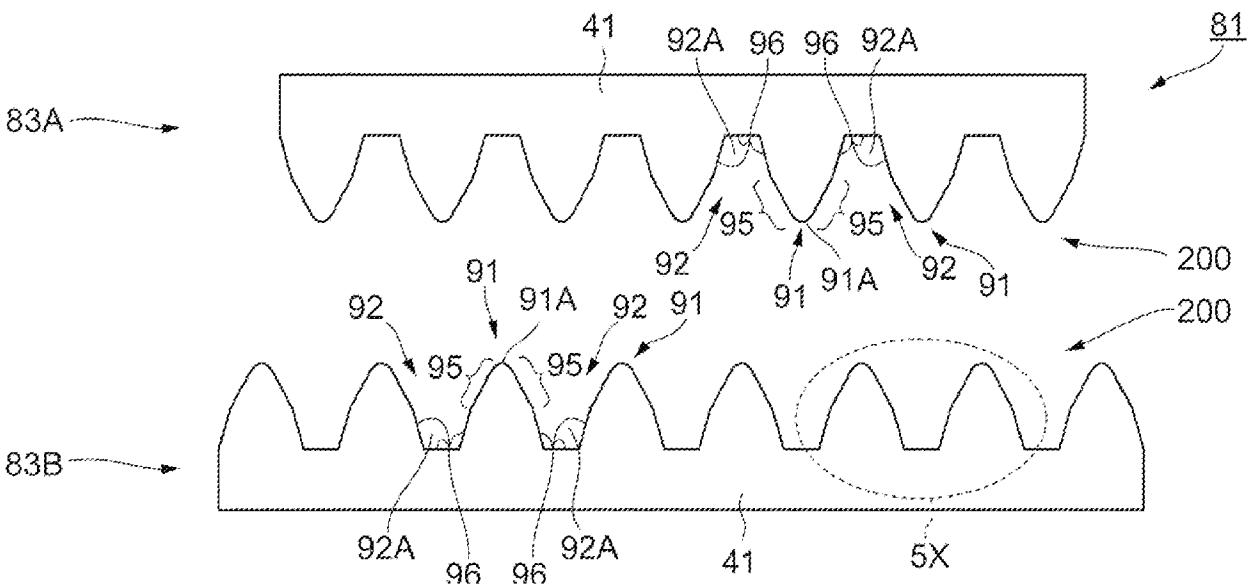
FIGS. 5A and 5B are views in a case where a binding member is viewed from an arrow V direction of FIG. 3.
Figure 5B:
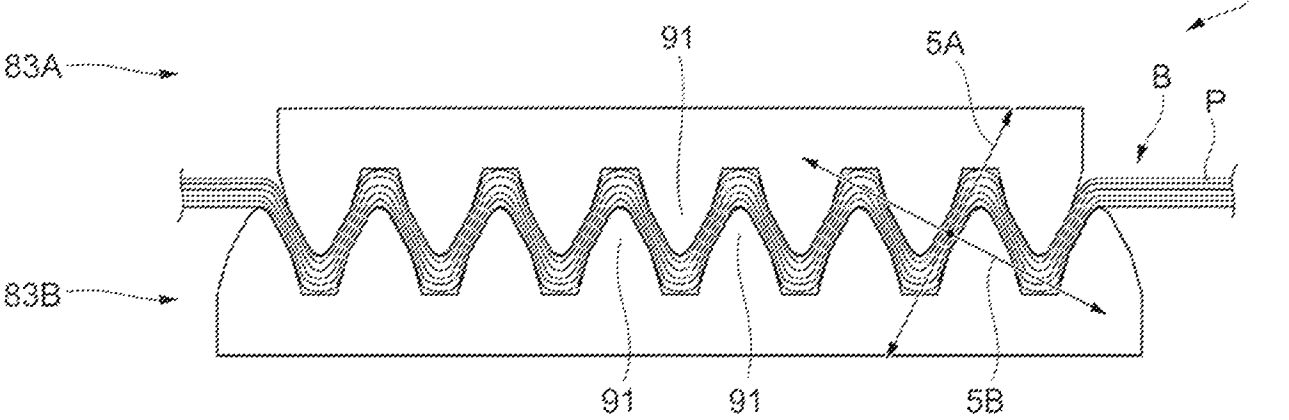

FIGS. 5A and 5B illustrate the binding member 81 viewed from an arrow V direction of FIG. 3. In other words, FIGS. 5A and 5B illustrate a sectional shape of the binding member 81. That is, FIGS. 5A and 5B illustrate the sectional shape of the binding member 81, which is a plane orthogonal to a direction in which convex portions 91 (details thereof to be described later) provided in the binding member 81 extend.

As illustrated in FIG. 5A, the binding member 81 is provided with the upper teeth 83A the lower teeth 83B.

The lower teeth 83B are provided with a base portion 41 extending in a right-and-left direction in FIG. 5A. An uneven portion 200 for forming unevenness in a bundle of paper is provided in one surface of the base portion 41 (upper portion of the base portion 41). In other words, one surface of the base portion 41 has a tooth form for forming unevenness in a bundle of paper.

The uneven portion 20) is provided with the convex portions 91 which are disposed so as to be arranged in a longitudinal direction (right-and-left direction in FIG. 5A) of the base portion 41 and concave portions 92 which are disposed so as to be arranged in the longitudinal direction of the base portion 41 in the same manner. The convex portions 91 and the concave portions 92 are disposed to extend in a direction orthogonal to the page of FIG. 5A.

In addition, each of the concave portions 92 is disposed between two convex portions 91 adjacent to each other. In other words, in the exemplary embodiment, the convex portions 91 and the concave portions 92 are alternately disposed in the longitudinal direction (right-and-left direction in FIG. 5A) of the base portion 41.

The upper teeth 83A are configured in the same manner, and also the upper teeth 83A are provided with the base portion 41 extending in the right-and-left direction in FIG. 5A. The uneven portion 200 for forming unevenness in a bundle of paper is provided in one surface of the base portion 41 (lower portion of the base portion 41).

In the exemplary embodiment, one surface of the base portion 41 of the upper teeth 83A has a tooth form for forming unevenness in a bundle of paper.

Also the upper teeth 83A are provided with the convex portions 91 which are disposed so as to be arranged in the longitudinal direction of the base portion 41 and the concave portions 92 which are disposed so as to be arranged in the longitudinal direction of the base portion 41 in the same manner.

The convex portions 91 and the concave portions 92 are disposed to extend in the direction orthogonal to the page of FIG. 5A. In addition, each of the concave portions 92 is disposed between two convex portions 91 adjacent to each other. As described above, the convex portions 91 and the concave portions 92 are alternately disposed.

Herein, each of the upper teeth 83A and the lower teeth 83B is provided with inclined portions 95.

The inclined portions 95 are provided on both sides (both side surfaces) of each of the convex portions 91 provided in the upper teeth 83A and the lower teeth 83B. In other words, the inclined portions 95 each are provided in a portion from each of top portions 91A of the convex portions 91 to each of trough portions 92A of the concave portions 92, which are positioned on both sides of the convex portions 91.

To describe further, the inclined portions 95 each are formed in a portion of outer surfaces of the convex portions 91, which obliquely goes down from each of the top portions 91A of the convex portions 91 to each of the trough portions 92A of the concave portions 92. In addition, the inclined portions 95 are linearly formed.

In the exemplary embodiment, grooves 96 having a trapezoidal sectional shape are formed in the trough portions 92A by cutting notches in the trough portions 92A of the concave portions 92 which are provided respectively in the upper teeth 83A and the lower teeth 83B.

Although the grooves 96 are formed in both of the upper teeth 83A and the lower teeth 83B in the exemplary embodiment, the grooves 96 may be formed in only one side of a row of the upper teeth 83A or the lower teeth 83B and the grooves 96 may be omitted in the other side.

In forming the grooves 96 in at least one side of a row of the upper teeth 83A or the lower teeth 83B, the grooves 96 may not be formed in a way to correspond to each of all the concave portions 92, and the grooves 96 may be formed to correspond to only a part of the concave portions 92.

In the exemplary embodiment, when performing binding processing with respect to a bundle of paper, the upper teeth 83A are caused to advance (drop) toward the lower teeth 83B in a state where the bundle of paper (not illustrated in FIG. 5A) is positioned between the upper teeth 83A and the lower teeth 83B.

Accordingly, (the uneven portion 200 provided in) the upper teeth 83A are pressed against one surface of the bundle of paper, and (the uneven portion 200 provided in) the lower teeth 83B are pressed against the other surface of the bundle of paper.

When the upper teeth 83A are caused to further advance, the upper teeth 83A approach the lower teeth 83B, and the bundle of paper B is brought into a state of being pressed (state of being sandwiched) by the upper teeth 83A and the lower teeth 83B, as illustrated in FIG. 5B.

In this state, the convex portions 91 of the upper teeth 83A are brought into a state where the convex portions have entered between the convex portions 91 of the lower teeth 83B. After then, in the exemplary embodiment, the upper teeth 83A retract from the bundle of paper B.

Through the processing described above, binding processing with respect to the bundle of paper B is completed.

When binding processing with respect to the bundle of paper B is completed, the shape of unevenness conforming to the uneven portion 200 is imparted to an upper surface and a lower surface of the bundle of paper B.

In addition, when binding processing with respect to the bundle of paper B is completed, the respective sheets of the paper P configuring the bundle of paper B is brought into a state of compressing each other.

Herein, in the exemplary embodiment, when the bundle of paper B is pressed by the upper teeth 83A and the lower teeth 83B, the bundle of paper B is stretched in a direction indicated with a reference sign 5A (direction orthogonal to a thickness direction of the bundle of paper B), as illustrated in FIG. 5B. Accordingly, in the respective sheets of the paper P configuring the bundle of paper B, fibers configuring the paper P are stretched and a clearance between fibers is in an expanded state.

At the time of binding processing, a pressure in a direction indicated with a reference sign 5B (thickness direction of the bundle of paper B) acts on the bundle of paper B. Accordingly, between fibers configuring one sheet of the paper P included in the bundle of paper B (between fibers having a clearance in an expanded state), fibers of another sheet of the paper P positioned next to this one sheet of the paper P enter.

After then, a pressure acting on the bundle of paper B is released. Accordingly, the fibers configuring one sheet of the paper P and the fibers configuring another sheet of the paper P are entangled, and thus the respective sheets of the paper P configuring the bundle of paper B compress each other.

Figure 6A:
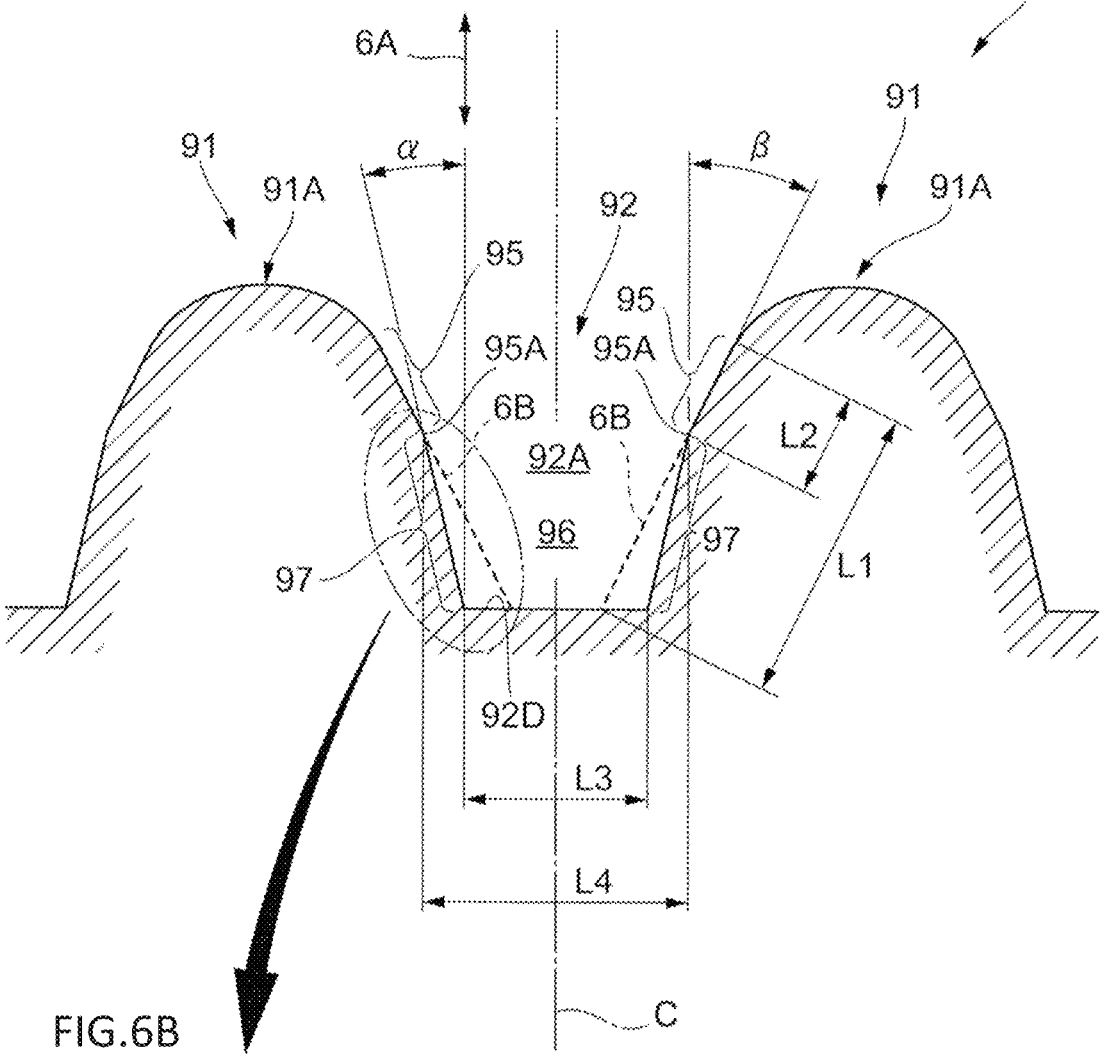
FIG. 6A is an enlarged view of a portion indicated with a reference sign 5X of FIG. 5A.
Figure 6B:
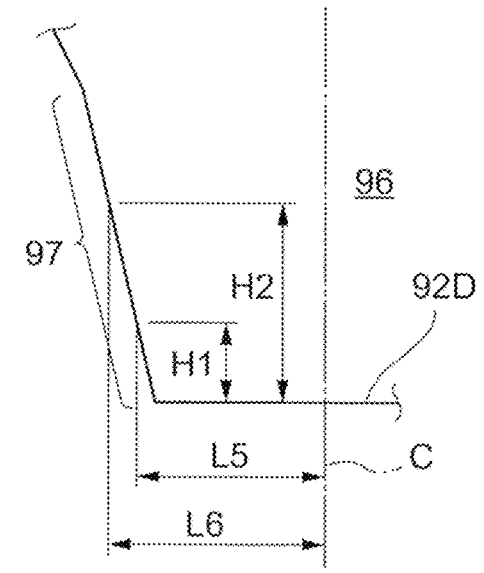
FIG. 6B is an enlarged view of a side surface and a bottom.

FIG. 6A is an enlarged view of a portion indicated with a reference sign 5X of FIG. 5A, and FIG. 6B is an enlarged view of a side surface 97 and a bottom 92D. Although the lower teeth 83B are illustrated in FIG. 6, the upper teeth 83A are also configured the same as the lower teeth 83B.

As described above, the grooves 96 of the lower teeth 83B of the exemplary embodiment are formed by cutting notches in the trough portions 92A of the concave portions 92.

More specifically, the grooves 96 having an inverted trapezoidal section that is a shape (sharpened shape), in which portions positioned on both sides of each of the trough portions 92A of the concave portions 92 (root portions of the convex portions 91, which are portions of outer surfaces of the convex portions 91) are eliminated from the lower teeth 83B, are formed in the trough portions 92A.

In the exemplary embodiment, since the grooves 96 are formed in such a manner, the lengths of the inclined portions 95 are small compared to a case where the inclined portions 95 reach the bottoms 92D of the trough portions 92A (compared to a case where the linearly inclined portions 95 reach the bottoms 92D of the trough portions 92A as it is (compared to a case where the inclined portions linearly reach the bottoms 92D of the trough portions 92A)).

In the configuration of the exemplary embodiment, the lengths of the inclined portions 95 are smaller as described above. In the exemplary embodiment, the grooves 96 are provided on a bottom 92D side of lower end portions 95A (end portions positioned on the bottom 92D side) of the inclined portions 95, which have a small length.

Dotted lines 6B illustrated in FIG. 6 indicate the linearly inclined portions 95 connecting the top portions 91A of the convex portions 91 and the bottoms 92D of the trough portions 92A together.

In the exemplary embodiment, by cutting notches in the trough portions 92A as described above, a part of each of the inclined portions 95 is eliminated (portions indicated with a reference sign 6B are eliminated), and thus the lengths of the inclined portions 95 become shorter.

More specifically, each of the lengths of the inclined portions 95 before cutting notches in the trough portions 92A is a length L1. In the exemplary embodiment, since notches are cut in the trough portions 92A to form the grooves 96, each of the lengths of the inclined portions 95 is a length L2 that is smaller than the length L1.

The grooves 96 of the exemplary embodiment are set such that each of the widths of the grooves 96 differs according to a position in a depth direction of the grooves 96.

Specifically, the grooves 96 of the exemplary embodiment are set such that a width IA of each of portions of the grooves 96 connected to the inclined portions 95 is larger than a width L3 of each of the bottoms 92D of the trough portions 92A.

In other words, in the exemplary embodiment, the widths of the grooves 96 expand from the bottoms 92D of the trough portions 92A toward a side on which the inclined portions 95 are positioned.

Accordingly, the bundle of paper B on which binding processing is performed is more likely to be removed from the lower teeth 83B and the upper teeth 83A compared to a case where the widths of the grooves 96 do not change regardless of the depths of the grooves 96.

In a case where the widths of the grooves 96 do not change regardless of the depths of the grooves 96, a frictional force acting on between the bundle of paper B and the upper teeth 83A or the lower teeth 83B is larger when removing the bundle of paper B on which binding processing is performed from the lower teeth 83B and the upper teeth 83A.

In this case, the bundle of paper B on which binding processing is performed is unlikely to be removed from the lower teeth 83B and the upper teeth 83A. In addition, in this case, when removing the bundle of paper B, a force to remove binding at a binding processing portion becomes larger and binding is likely to be removed.

On the other hand, as in the exemplary embodiment, in a case where the widths of the grooves 96 expand from the bottoms 92D of the trough portions 92A toward the side on which the inclined portions 95 are positioned, a frictional force acting on between the bundle of paper B and the upper teeth 83A or the lower teeth 83B is smaller.

Accordingly, the bundle of paper B is likely to be removed from the lower teeth 83B and the upper teeth 83A. In addition, a force to remove binding becomes smaller, and thus binding is unlikely to be removed.

To describe further, as illustrated in FIG. 6, in the exemplary embodiment, each of the two side surfaces 97 which are positioned on both sides of the each of the grooves 96 and face each of the grooves 96 has an angle with respect to the advancing/retracting direction of the upper teeth 83A (direction indicated with a reference sign 6A, hereinafter, referred to as "advancing/retracting direction 6A") and is inclined with respect to the advancing/retracting direction 6A.

Accordingly, in the exemplary embodiment, the widths of the grooves 96 expand from the bottoms 92D of the trough portions 92A toward the side on which the inclined portions 95 are positioned, as described above.

That is, in the exemplary embodiment, the two side surfaces 97 desired in each of the grooves 96 are formed such that a part positioned at a portion separated further away from each of centers C (centers C in the width direction) of the grooves 96 has a larger height from each of the bottoms 92D.

More specifically, a portion separated away from the center of each of the grooves 96 by a distance L5 has a height of H, which is a height from each of the bottoms 92D, and a portion separated away from the center of each of the grooves 96 by a distance L6 (>L5) has a height of H2, which is a height from each of the bottoms 92D and is larger than the H1.

In the exemplary embodiment, as described above, the advancing/retracting direction 6A is the advancing/retracting direction of the upper teeth 83A. In the exemplary embodiment, as described above, the two side surfaces 97 facing each of the grooves 96 are provided on both sides of each of the grooves 96. In the exemplary embodiment, the two side surfaces 97 are inclined with respect to the advancing/retracting direction 6A.

Although the two side surfaces 97 are inclined with respect to the advancing/retracting direction 6A in the exemplary embodiment, only one of the side surfaces 97 may be inclined. Also in this case, the widths of the grooves 96 expand from the bottoms 92D of the trough portions 92A toward the side on which the inclined portions 95 are positioned as in the case described above.

In the exemplary embodiment, an angle $\alpha$ of each of the side surfaces 97 with respect to the advancing/retracting direction 6A is larger than 20 degrees. In addition, the angle $\alpha$ of each of the side surfaces 97 with respect to the advancing/retracting direction 6A is smaller than an angle 3 of each of the inclined portions 95 with respect to the advancing/retracting direction 6A.

When removing the bundle of paper B from the upper teeth 83A and the lower teeth 83B after binding processing, both frictional forces are likely to become larger and the bundle of paper B is unlikely to be removed from the upper teeth 83A and the lower teeth 83B in a case where the angle of each of the side surfaces 97 with respect to the advancing/retracting direction 6A is equal to or smaller than 20 degrees.

In the exemplary embodiment, in performing binding processing with respect to the bundle of paper B, not the inclined portions configured of the side surfaces 97 but the inclined portions 95 come into contact with the bundle of paper B first.

In the exemplary embodiment, in a case where angles with respect to the advancing/retracting direction 6A are compared, the angle of each of the inclined portions 95 with respect to the advancing/retracting direction 6A is larger than the angle of each of the inclined portions configured of the side surfaces 97 with respect to the advancing/retracting direction 6A. In the exemplary embodiment, in performing binding processing with respect to the bundle of paper B, the inclined portions 95, which are the inclined portions having a larger angle with respect to the advancing/retracting direction 6A, come into contact with the bundle of paper B earlier than the inclined portions configured of the side surfaces 97 do.

In the exemplary embodiment, as illustrated in FIG. 6A, each of the lengths (=L2) of the inclined portions 95 is smaller than each of the lengths of the inclined portions configured of the side surfaces 97.

Figure 7:
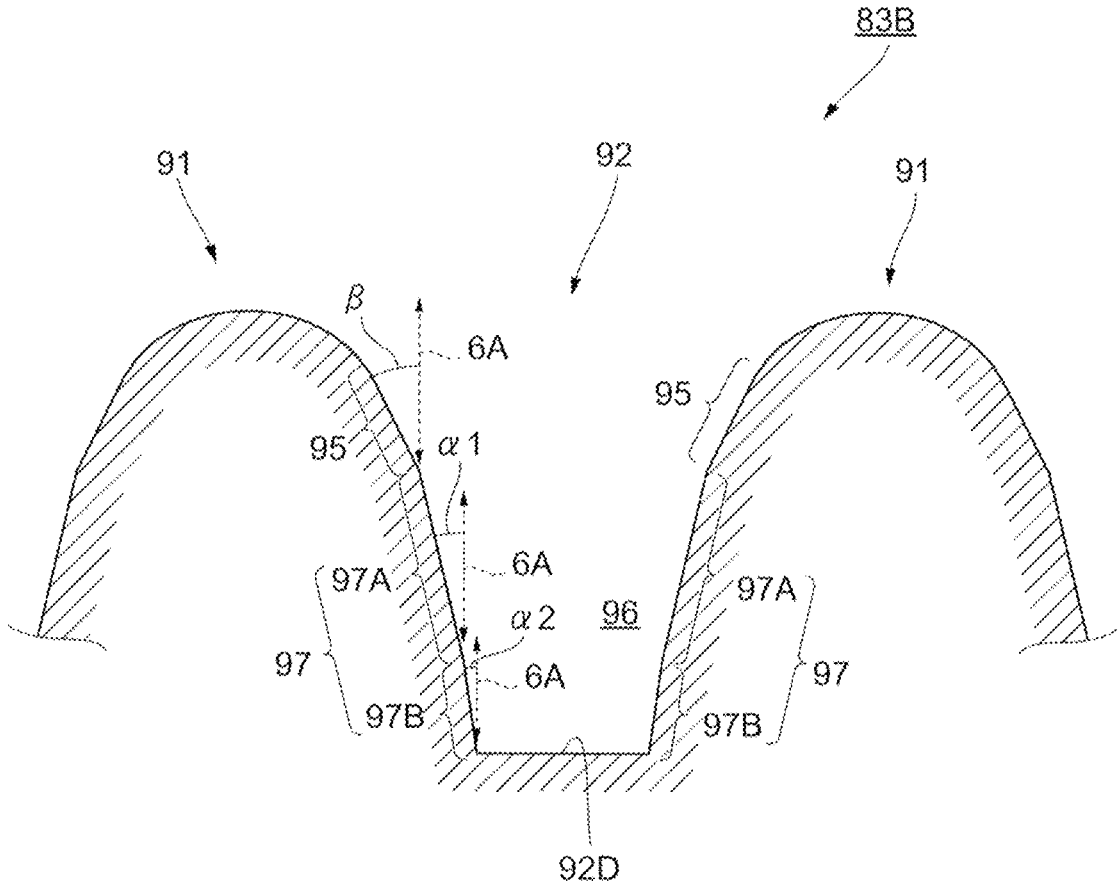
FIG. 7 illustrates another configuration example of a groove.

FIG. 7 illustrates another configuration example of the grooves 96.

In the configuration example illustrated in FIG. 7, the grooves 96 are formed in multiple stages. That is, in the configuration example illustrated in FIG. 7, each of the side surfaces 97 is not a single surface. Each of the side surfaces 97 is configured with two surfaces including a first surface 97A and a second surface 97B.

More specifically, in the configuration example, the second surfaces 97B are configured to be additionally provided at portions positioned below the side surfaces 97 illustrated in FIG. 6.

More specifically, the depths of the grooves 96 in FIG. 7 are larger than the depths of the grooves 96 illustrated in FIG. 6, and accordingly, the second surfaces 97B are configured to be additionally provided on both sides of each of the grooves 96. In this case, the volume of a space in each of the grooves 96 is large compared to the configuration example illustrated in FIG. 6.

Each of the first surfaces 97A is formed in a state where each first surface faces each of the grooves 96 and an angle $\alpha$1 with respect to the advancing/retracting direction 6A is large. In addition, the second surfaces 97B are positioned closer to the bottoms 92D than the first surfaces 97A are, and an angle $\alpha$2 with respect to the advancing/retracting direction 6A is smaller than the angle $\alpha$1, which is the angle of each of the first surfaces 97A.

Both of the angle $\alpha$1 of each of the first surfaces 97A with respect to the advancing/retracting direction 6A and the angle $\alpha$2 of each of the second surfaces 97B with respect to the advancing/retracting direction 6A are smaller than the angle 3 of each of the inclined portions 95 with respect to the advancing/retracting direction 6A.

In deepening the grooves 96, the two side surfaces 97 illustrated in FIG. 6 may be extended downwards instead of providing multiple stages as in FIG. 7. In this case, the widths of the grooves 96 are smaller at portions of the bottoms 92D. In this case, the paper P is unlikely to enter the grooves 96.

In a case where the second surfaces 97B having a smaller angle with respect to the advancing/retracting direction 6A than the first surfaces 97A have are additionally formed as in the exemplary embodiment, the widths of the grooves 96 at the bottoms 92D expand and the paper P is likely to enter the grooves 96 compared to a case where the side surfaces 97 are extended downwards, as described above.

In the configuration example illustrated in FIG. 7, an angle of each of the first surfaces 97A with respect to the advancing/retracting direction 6A may be equal to or larger than 20 degrees.

Moreover, the angle of each of the second surfaces 97B with respect to the advancing/retracting direction 6A may be equal to or larger than 20 degrees, and the angle of each of the first surfaces 97A with respect to the advancing/retracting direction 6A is larger than the angle of each of the second surfaces 97B with respect to the advancing/retracting direction 6A.

Figure 8:
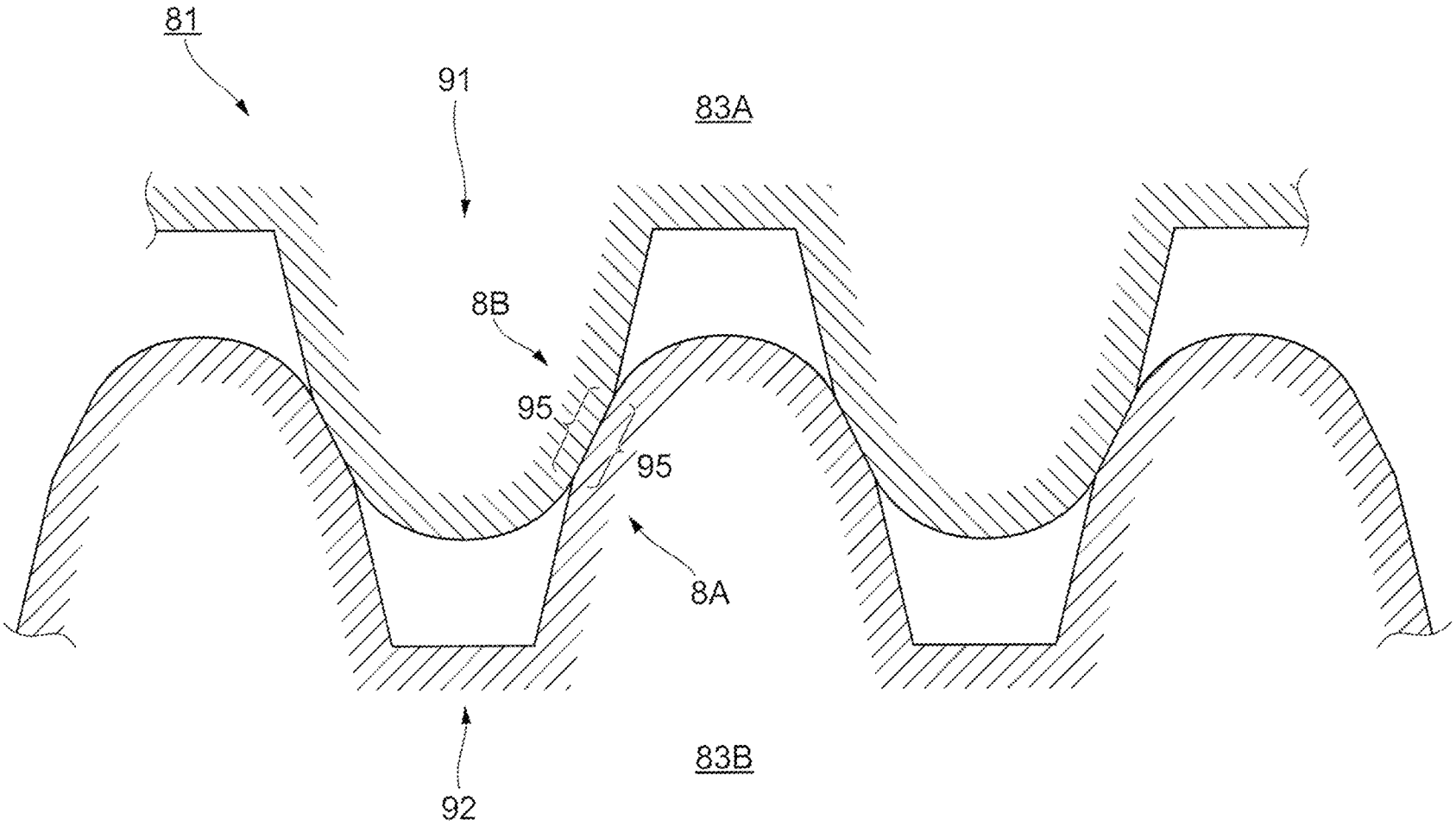
FIG. 8 illustrates a state where upper teeth are meshed with lower teeth without a bundle of paper being sandwiched therebetween.

FIG. 8 illustrates a state where the upper teeth 83A are meshed with the lower teeth 83B without the bundle of paper B being sandwiched therebetween. In other words, FIG. 8 illustrates a state where the upper teeth 83A and the lower teeth 83B are brought into contact with each other, which is a state where the bundle of paper B has not entered between the upper teeth 83A and the lower teeth 83B.

As illustrated in FIG. 8, in the exemplary embodiment, when the upper teeth 83A are meshed with the lower teeth 83B without the bundle of paper B being sandwiched therebetween, the inclined portion 95 (inclined portion 95 indicated with reference sign 8A) having a tooth form, which forms the concave portion 92, and the inclined portion 95 (inclined portion 95 indicated with a reference sign 8B) having a tooth form, which forms the convex portion 91 confronting the concave portion 92, come into contact with each other, thereby generating a region where the two inclined portions 95 are in contact with each other.

In the exemplary embodiment, when the upper teeth 83A are meshed with the lower teeth 83B without the bundle of paper B being sandwiched therebetween, the inclined portions 95 formed in the lower teeth 83B and the inclined portions 95 formed in the upper teeth 83A come into contact with each other.

More specifically, the inclined portions 95 of the convex portions 91 included in one side of a row of the upper teeth 83A or the lower teeth 83B and the inclined portions 95 of the convex portions 91 provided in the other side of a row of teeth, which are the convex portions 91 in contact with the convex portions 91 of the one side of a row of teeth, come into contact with each other.

Accordingly, in the exemplary embodiment, a pressure acting on in the thickness direction of the bundle of paper B (pressure acting on in a direction indicated with an arrow 5B in FIG. 5B) is more reliably generated compared to a case where the inclined portions 95 are not in contact with each other.

In the exemplary embodiment, as illustrated in FIG. 8, the inclined portions 95 formed in the lower teeth 83B and the inclined portions 95 formed in the upper teeth 83A are planarly in contact with each other. Accordingly, a pressure acts on over a wide area of the bundle of paper B compared to a case of not being planarly in contact with each other.

However, in a case where binding processing with respect to the bundle of paper B configured with a large number of sheets of the paper P, such as 6 to 10 sheets, is performed by teeth that used to carry out binding on the bundle of paper B configured with a small number of sheets of the paper P, such as 2 to 5 sheets, a paper P binding performance is likely to deteriorate.

It is desirable to change the sizes of teeth carrying out binding on the bundle of paper B according to the number of sheets of the paper P configuring the bundle of paper B (according to the thickness of the bundle of paper B). When binding processing is performed with respect to the thick bundle of paper B by using small teeth (teeth having small convex portions 91), a paper P binding performance is likely to deteriorate. More specifically, a shift in teeth is likely to occur, and thus insufficient compression of the bundle of paper B is likely to occur.

Herein, the shift in teeth is a phenomenon in which one side of a row of the upper teeth 83A or the lower teeth 83B moves in a longitudinal direction of teeth (direction in which the base portion 41 illustrated in FIG. 5A extends (right-and-left direction in FIG. 5A)).

Figure 9:
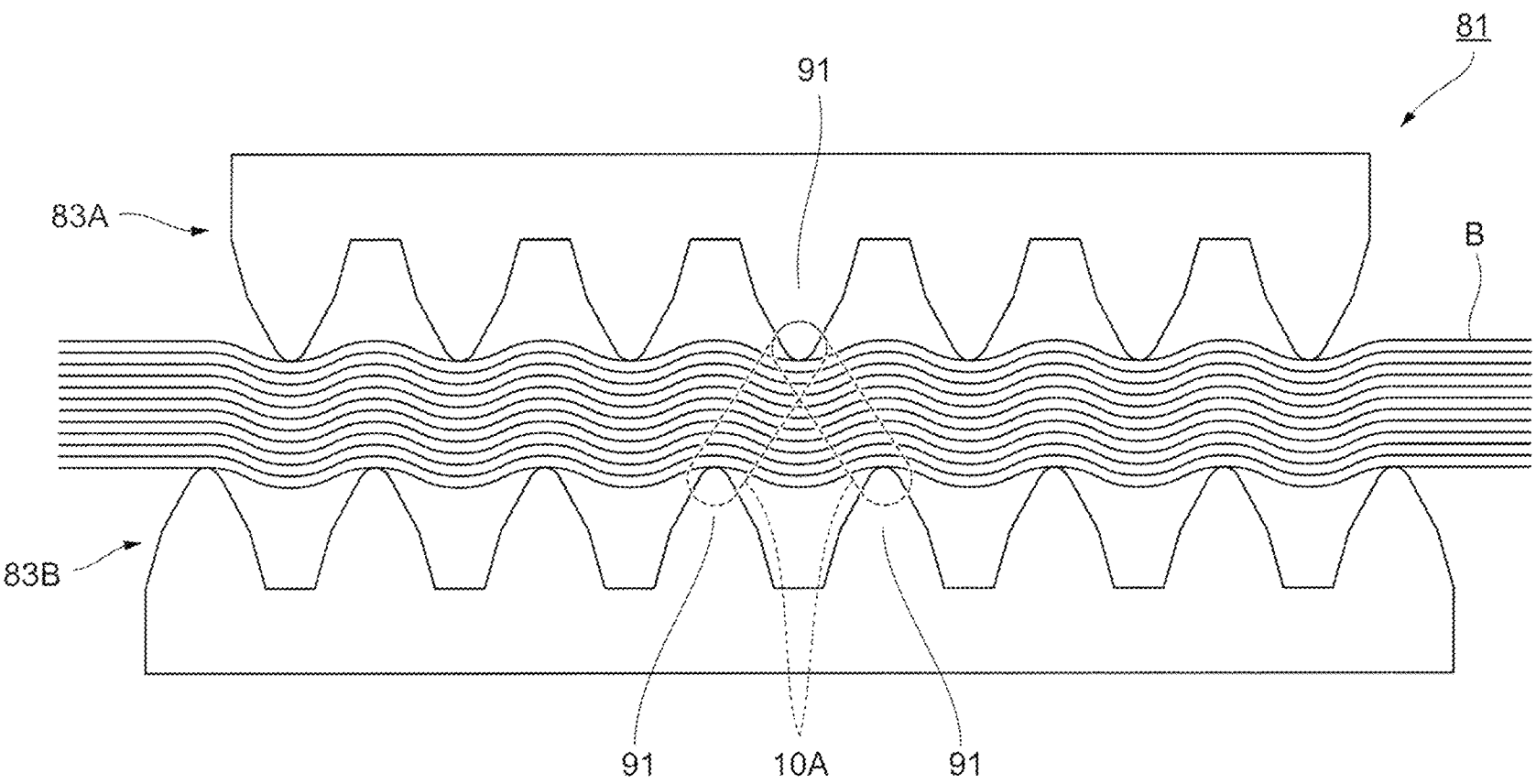
FIG. 9 illustrates a state when binding processing is performed with respect to the thick bundle of paper by teeth having a small convex portion.

When binding processing is performed with respect to the thick bundle of paper B by using small teeth, the bundle of paper B is likely to be kept in a flat state, and the bundle of paper B is unlikely to enter between the convex portions 91 configuring teeth as illustrated in FIG. 9 (illustrating a state when binding processing is performed with respect to the thick bundle of paper B by teeth having the small convex portions 91).

In this case, a load intensively acts on portions indicated with dashed lines 10A, and the bundle of paper B is likely to tear at these portions. When the tear occurs, the convex portions 91 configuring teeth penetrate into the bundle of paper B at the portions of the tear. Accordingly, in this example, the upper teeth 83A move in the longitudinal direction of the upper teeth 83A (right-and-left direction in FIG. 9). In this case, compared to a case where the upper teeth 83A make an original movement in which the upper teeth 83A do not move, a pressure is unlikely to be applied to the bundle of paper B and a binding processing performance deteriorates.

Herein, in avoiding the occurrence of such a defect, it is sufficient to make the upper teeth 83A and the lower teeth 83B larger (it is sufficient to make the convex portions 91 provided in the upper teeth 83A and the lower teeth 83B larger, and to make a pitch at which the convex portions 91 are disposed larger). However, when the upper teeth 83A and the lower teeth 83B are made larger, the lengths of the inclined portions 95 provided in each of the teeth become larger.

In this case, a contact area between the bundle of paper B and the inclined portions 95 increases at the time of binding processing, drag acting on the teeth becomes larger when the teeth are caused to advance toward the bundle of paper B. Along with this, a load necessary for binding the bundle of paper B becomes larger.

On the other hand, in the configuration of the exemplary embodiment, the grooves 96 are formed and the lengths of the inclined portions 95 are smaller, as described above. Accordingly, in the exemplary embodiment, drag acting on the teeth (upper teeth 83A and lower teeth 83B) from the bundle of paper B is smaller, and a load necessary for binding the bundle of paper B is smaller.

When the grooves 96 are formed as in the exemplary embodiment, an escape for the paper P configuring the bundle of paper B sandwiched between the upper teeth 83A and the lower teeth 83B expands. In this case, an amount by which the upper teeth 83A are caused to advance is larger.

When an amount by which the upper teeth 83A advance is larger, the paper P positioned in a middle portion in the thickness direction (hereinafter, referred to as "middle paper"), out of sheets of the paper P included in the bundle of paper B, extend, and a force for binding is applied to a larger number of sheets of the paper P.

More specifically, at the time of binding processing on the bundle of paper B, as described above, the respective sheets of the paper P configuring the bundle of paper B extend, and a clearance between fibers configuring the paper P expand. However, when the bundle of paper B is thicker, the middle paper positioned in the middle portion in the thickness direction is unlikely to extend, and the clearance between fibers is unlikely to be generated.

In this case, a binding force applied between the middle paper and the paper P positioned adjacent to the middle paper is unlikely to be generated.

On the contrary, in the configuration of the exemplary embodiment, the grooves 96 are formed and the paper P is likely to enter in the grooves 96. Along with this, an amount by which the upper teeth 83A advance is larger.

In this case, the middle paper is more likely to extend, and a binding force applied between the middle paper and the paper P positioned adjacent to the middle paper is likely to be generated.

In the configuration of the exemplary embodiment, as a result of providing the grooves 96 as described above, the extension rate of the paper P becomes larger. Consequently, there is a concern over the tear of the paper P in the thin bundle of paper B.

However, due to the grooves 96, the paper P starts extending in a state where the paper P is more strongly sandwiched between the inclined portions 95 of the upper teeth 83A and the inclined portions 95 of the lower teeth 83B and the paper P is sandwiched under a high pressure. In this case, entanglement between fibers configuring the bundle of paper B is maintained by the high pressure, and thus the tear of the paper P is unlikely to occur.

<Recording Material Processing System 500>

Figure 10:
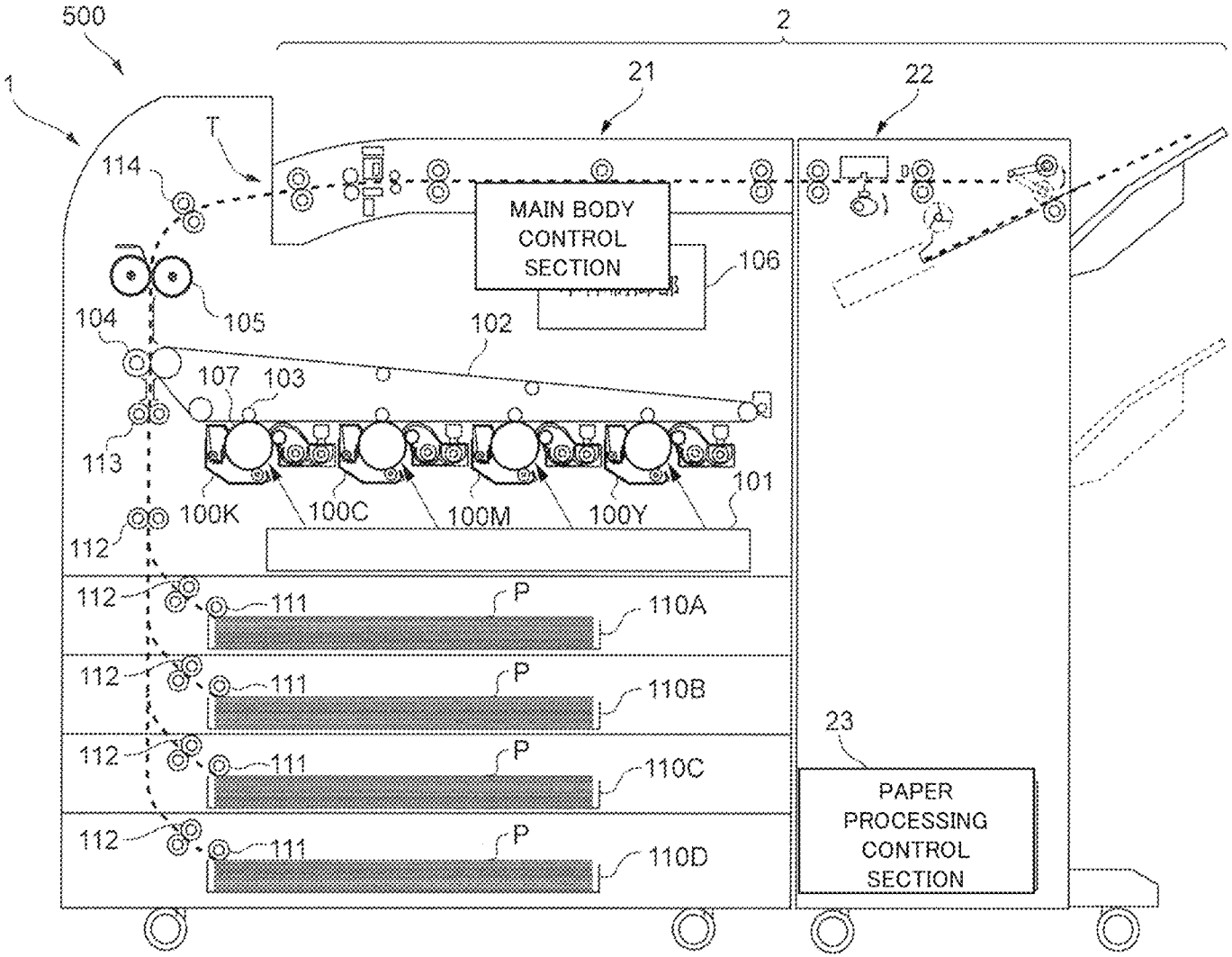
FIG. 10 illustrates a configuration of a recording material processing system to which the exemplary embodiment is applied.

FIG. 10 illustrates a configuration of a recording material processing system 500 to which the exemplary embodiment is applied.

The recording material processing system 500 functioning as one of image processing apparatuses is provided with the image forming apparatus 1 that causes the image forming portions to form an image by using an electrographic process with respect to a recording material (sheet) such as the paper P and the post-processing apparatus 2 that performs post-processing with respect to the sheets of paper P on which an image is formed by the image forming apparatus 1. The image forming apparatus 1 and the post-processing apparatus 2 also function as one of image processing apparatuses as a single apparatus.

<Image Forming Apparatus 1>

The image forming apparatus 1 includes the four image forming units 100Y, 100M, 100C, and 100K (collectively referred to as "image forming units 100"), which form an image based on image data in each color. The image forming apparatus 1 is provided with the laser exposure device 101 that exposes the photoconductor drums 107 provided in the respective image forming units 100 and forms an electrostatic latent image onto the surfaces of the photoconductor drums 107.

In addition, the image forming apparatus 1 is provided with the intermediate transfer belt 102 on which a toner image in each color formed by each of the image forming units 100 is multiply transferred and the primary transfer rolls 103 that transfer (primary transfer) the toner image in each color formed by each of the image forming units 100 in turn onto the intermediate transfer belt 102. The secondary transfer roll 104 that transfers (secondary transfer) the toner image in each color, which is transferred on the intermediate transfer belt 102, at once onto the paper P, the fixing device 105 that fixes the secondarily transferred toner image in each color onto the paper P, and the main body control section 106 that controls operation of the image forming apparatus 1 are provided.

In each of the image forming units 100, the photoconductor drum 107 is charged and an electrostatic latent image is formed onto the photoconductor drum 107. Then, the electrostatic latent image is developed, and a toner image in each color is formed onto a surface of the photoconductor drum 107.

The toner image in each color, which is formed on the surface of the photoconductor drum 107, is transferred in turn onto the intermediate transfer belt 102 by each of the primary transfer rolls 103. As the intermediate transfer belt 102 moves, the toner image in each color is transported to a position where the secondary transfer roll 104 is disposed.

Different sizes or different types of the paper P are accommodated in the paper accommodating units 110A to 110D of the image forming apparatus 1. For example, the paper P is picked up from the paper accommodating unit 110A by the pickup roll 111, and is transported to the position of the resist roll 113 by the transport roller 112.

In accordance with a timing when the toner image in each color on the intermediate transfer belt 102 is transported to the secondary transfer roll 104, the paper P is supplied from the resist roll 113 to an opposing portion (secondary transfer portion) where the secondary transfer roll 104 and the intermediate transfer belt 102 are opposed to each other.

Accordingly, the toner image in each color on the intermediate transfer belt 102 is electrostatically transferred (secondary transfer) onto the paper P at once by the action of a transfer electric field formed by the secondary transfer roll 104.

After then, the paper P, on which the toner image in each color is transferred, is separated from the intermediate transfer belt 102 and is transported to the fixing device 105. In the fixing device 105, the toner image in each color is fixed onto the paper P by fixing processing by heat and a pressure, and thus an image is formed onto the paper P.

Then, the paper P on which the image is formed is output from the paper outputting portion T of the image forming apparatus 1 by the transport roller 114 and is supplied to the post-processing apparatus 2 connected to the image forming apparatus 1.

The post-processing apparatus 2 is disposed on the downstream side of the paper outputting portion T of the image forming apparatus 1, and performs post-processing such as punching and binding with respect to the paper P on which an image is formed.

<Post-Processing Apparatus 2>

Figure 11:
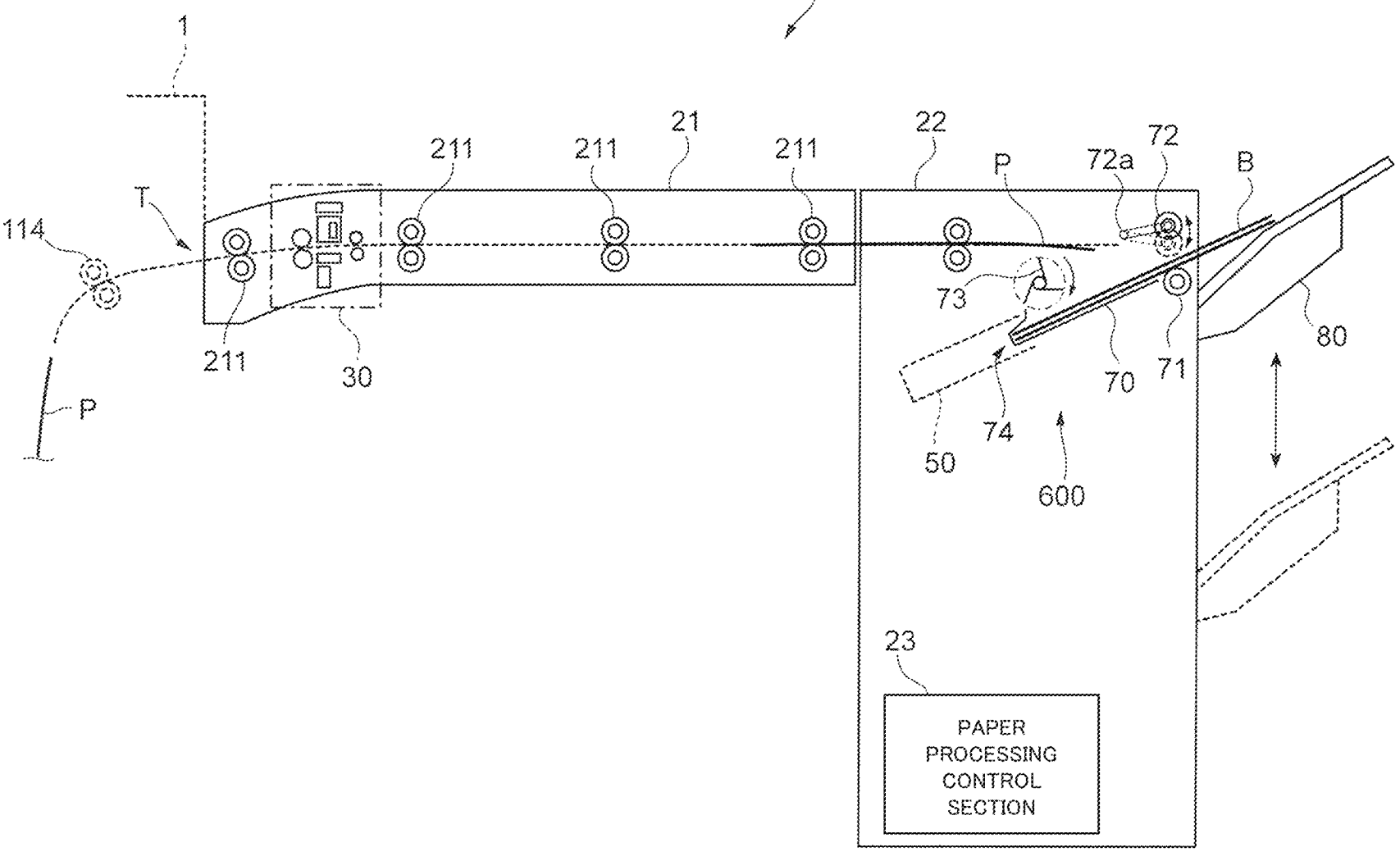
FIG. 11 illustrates the configuration of the post-processing apparatus to which the exemplary embodiment is applied.

FIG. 11 illustrates a configuration of the post-processing apparatus 2.

As illustrated in FIG. 11, the post-processing apparatus 2, which functions as one of image processing apparatuses, includes the transport unit 21 connected to the paper outputting portion T of the image forming apparatus 1 and the finisher unit 22 that carries out processing determined in advance with respect to the paper P transported by the transport unit 21. Each of various types of transport paths of the transport unit 21 and the finisher unit 22 functions as one of transporting units that transport a recording material on which an image is formed. A transport path of the image forming apparatus 1 after image-forming also functions as one of transporting units.

In addition, the post-processing apparatus 2 includes the paper processing control section 23 that controls each mechanism unit of the post-processing apparatus 2. The paper processing control section 23 is connected to the main body control section 106 (refer to FIG. 10) by a signal line (not illustrated), and transmits and receives a control signal to and from the main body control section.

In addition, the post-processing apparatus 2 includes a stacker unit 80 on which the paper P (bundle of paper B) processed by the post-processing apparatus 2 is stacked.

As illustrated in FIG. 11, the transport unit 21 of the post-processing apparatus 2 is provided with the punching unit 30 that carries out punching of two holes or four holes.

The transport unit 21 is further provided with the transport rollers 211 that transport the paper P on which an image is formed by the image forming apparatus 1 to the finisher unit 22.

The finisher unit 22 is provided with a binding processing device 600 that performs binding processing with respect to the bundle of paper B, which is an example of a bundle of recording materials. The binding processing device 600 of the exemplary embodiment functions as one of binding portions, causes fibers configuring the paper P to be entangled with each other without using a staple (needle), and performs binding processing with respect to the bundle of paper B.

The binding processing device 600 is provided with a paper collecting unit 70 that supports the paper P from below and collects a necessary number of sheets of the paper P to create the bundle of paper B. The paper collecting unit 70 functions as a stand on which a bundle of recording materials (bundle of paper B), which is obtained by making recording materials (paper P) transported by the transporting unit into a bundle, is placed. In addition, the binding processing device 600 is provided with a binding unit 50 that performs binding processing with respect to the bundle of paper B. In addition to a form in which the paper P is transported one by one and the bundle of paper B is accommodated, the paper collecting unit 70 has a form in which the bundle of paper B is transported at once and is accommodated.

In addition, the binding processing device 600 is provided with a sending-out roller 71 and a moving roller 72. The sending-out roller 71 rotates in a clockwise direction in FIG. 11 and sends the bundle of paper B on the paper collecting unit 70 to the stacker unit 80.

The moving roller 72 is provided so as to be movable about a rotation shaft 72*a*, and is positioned at a portion of being retracted from the sending-out roller 71 when the paper collecting unit 70 collects the paper P. In addition, when sending the created bundle of paper B to the stacker unit 80, the bundle of paper B on the paper collecting unit 70 is pressed.

Processing performed by the post-processing apparatus 2 will be described.

In the exemplary embodiment, an instruction signal indicating the execution of processing with respect to the paper P is output from the main body control section 106 to the paper processing control section 23. By the paper processing control section 23 receiving the instruction signal, the post-processing apparatus 2 executes processing with respect to the paper P.

In processing performed by the post-processing apparatus 2, first, the paper P on which an image is formed by the image forming apparatus 1 is supplied to the transport unit 21 of the post-processing apparatus 2. After the punching unit 30 performs punching according to an instruction signal from the paper processing control section 23, the paper P is transported to the finisher unit 22 by the transport rollers 211, in the transport unit 21.

In a case where there is no punching instruction from the paper processing control section 23, the paper P is sent to the finisher unit 22 as it is without punching processing being performed by the punching unit 30.

The paper P sent to the finisher unit 22 is transported to the paper collecting unit 70 provided in the binding processing device 600. The paper P slidingly moves on the paper collecting unit 70 due to an inclination angle imparted to the paper collecting unit 70, and abuts against paper regulating units 74 provided at an end portion of the paper collecting unit 70.

Accordingly, the paper P stops moving. In the exemplary embodiment, by the paper P abutting against the paper regulating units 74, the bundle of paper B in a state where the trailing end portion of the paper P is aligned is created on the paper collecting unit 70. In the exemplary embodiment, a rotation paddle 73 that moves the paper P to the paper regulating units 74 is provided.

Figure 12:
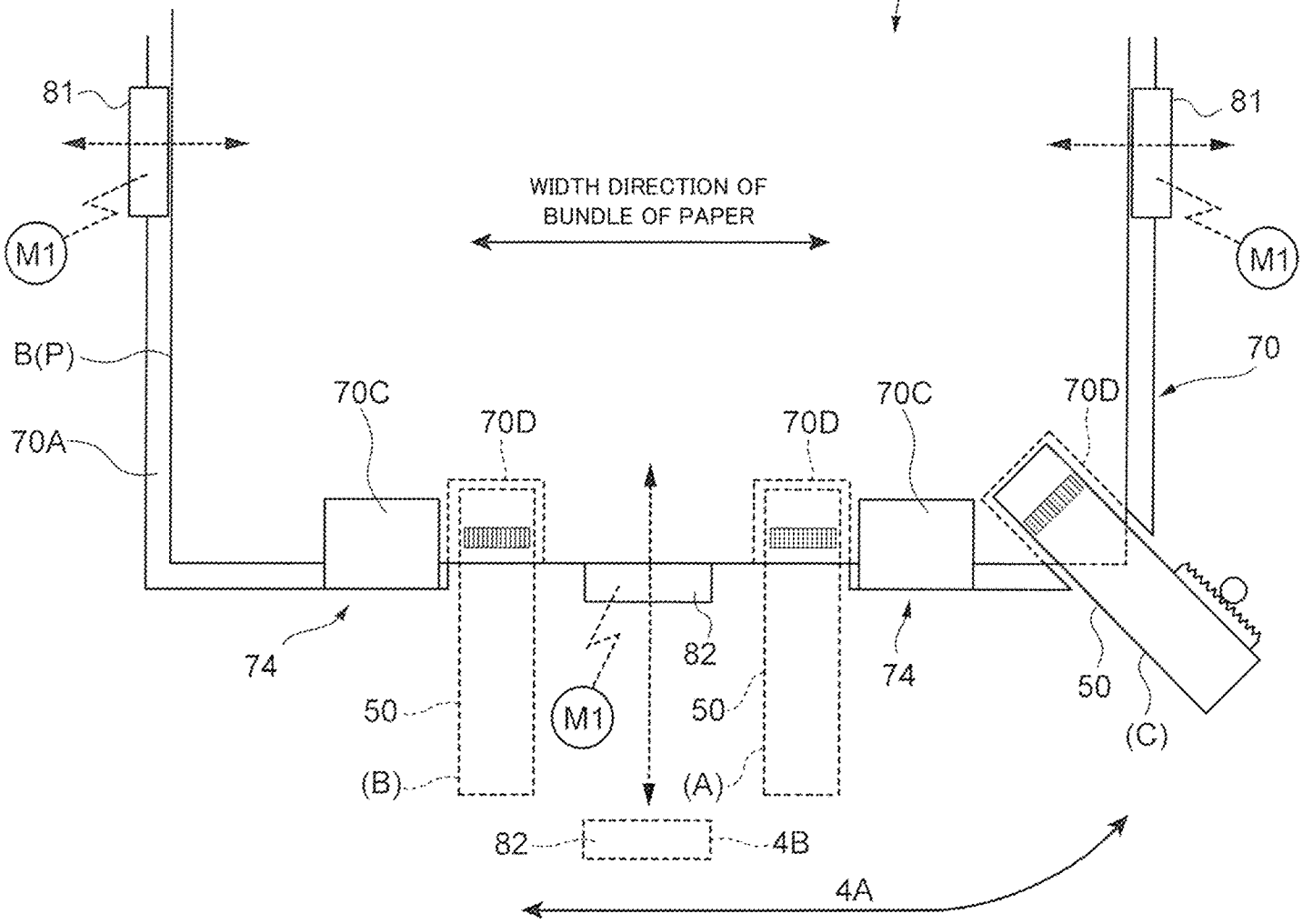
FIG. 12 illustrates a binding processing device to which the exemplary embodiment is applied viewed from above.

FIG. 12 illustrates the binding processing device 600 viewed from above.

First moving members 81 are provided at both end portions of the paper collecting unit 70 in the width direction.

The first moving members 81 are pressed against the sides of the paper P configuring the bundle of paper B, and the positions of the end portions of the paper P configuring the bundle of paper B are aligned. In addition, the first moving members 81 move in the width direction of the bundle of paper B to move the bundle of paper B in the width direction of the bundle of paper B.

Specifically, in the exemplary embodiment, when the paper P is collected on the paper collecting unit 70, the first moving members 81 are pressed against the sides of the paper P and the positions of the sides of the paper P are aligned.

As will be described later, in a case where the binding position of the bundle of paper B is changed, the bundle of paper B is pressed by the first moving members 81, and thus the bundle of paper B moves in the width direction of the bundle of paper B.

The binding processing device 600 of the exemplary embodiment is further provided with a second moving member 82.

The second moving member 82 moves in an up-and-down direction in FIG. 12 to move the bundle of paper B in a direction orthogonal to the width direction of the bundle of paper B.

In the exemplary embodiment, motors for moving M1 that move the first moving members 81 and the second moving member 82 are further provided.

As shown with an arrow 4A of FIG. 12, the binding unit 50 is provided so as to be movable in the width direction of the paper P. The binding unit 50 performs binding processing (two-portion binding processing), for example, with respect to two points ((A) position and (B) position) positioned at different positions in the width direction of the bundle of paper B.

The binding unit 50 moves to a (C) position in FIG. 12 and performs binding processing (one-point binding) with respect to a corner of the bundle of paper B.

Although the binding unit 50 linearly moves between the (A) position and the (B) position, the binding unit 50 moves while rotating, for example, by 45° between the (A) position and the (C) position.

The paper regulating units 74 are formed in a U-shape. On the inside of the U-shape, a regulating unit (not illustrated) extending upwards from the bottom plate 70A is provided. A leading end portion of the transported paper P comes into contact with the regulating unit, thereby regulating the movement of the paper P. In addition, the paper regulating units 74 formed in a U-shape have opposing portions 70C disposed so as to be opposed to the bottom plate 70A. The opposing portions 70C come into contact with the uppermost paper P in the bundle of paper B, and regulate the movement of the paper P in the thickness direction of the bundle of paper B.

In the exemplary embodiment, the binding unit 50 performs binding processing at portions where the paper regulating units 74 and the second moving member 82 are not provided.

Specifically, as illustrated in FIG. 12, the binding unit 50 performs binding processing between the paper regulating unit 74 positioned on the left in FIG. 12 and the second moving member 82, and between the paper regulating unit 74 positioned on the right in FIG. 12 and the second moving member 82. In addition, in the exemplary embodiment, binding processing is performed at a portion adjacent to the paper regulating units 74 on the right in FIG. 12 (corner of the bundle of paper B).

As illustrated in FIG. 12, the bottom plate 70A is provided with three notches 70D. Accordingly, interference between the paper collecting unit 70 and the binding unit 50 is avoided.

In the exemplary embodiment, when the binding unit 50 moves, the second moving member 82 moves to a position which is indicated with a reference sign 4B and is illustrated in a dashed line in FIG. 12. Accordingly, interference between the binding unit 50 and the second moving member 82 is avoided.

<Structure of Binding Unit 50>

Next, the binding unit 50, which is a distinctive configuration of the exemplary embodiment, will be described in detail.

The binding unit 50 to which the exemplary embodiment is applied functions as a binding device that binds a bundle of recording materials (bundle of paper B) without a needle. The bundle of paper B is bound by pressing, for example, the bundle of paper B with 2 to 10 sheets by using the upper teeth and the lower teeth. At this time, in particular, in order to thoroughly bind the bundle of paper B formed of a large number of sheets of paper, for example, 6 to 10 sheets, a significantly large pressing force is required compared to a case of binding the bundle of paper B with a small number of sheets of paper, for example, 2 to 3 sheets. In the binding unit 50 to which the exemplary embodiment is applied, for example, a pressing force of approximately 10,000 newtons is realized by a configuration to be described later. Even in a binding device in which such a large pressing force is obtained, the suppression of an increase in costs or an increase in the size of the device can be realized without increasing a moving distance of a pressing member. A stapler device with a needle of the related art can replace the binding device and can be realized by being disposed at the same place. In addition, although an opening in an initial state can be made larger in the stapler device with a needle of the related art, it is generally difficult to make the opening larger in a stapler device without a needle. However, in the binding unit 50 to which the exemplary embodiment is applied, a sufficient opening can be secured in an initial state by using a mechanism to be described later.

Figure 13:
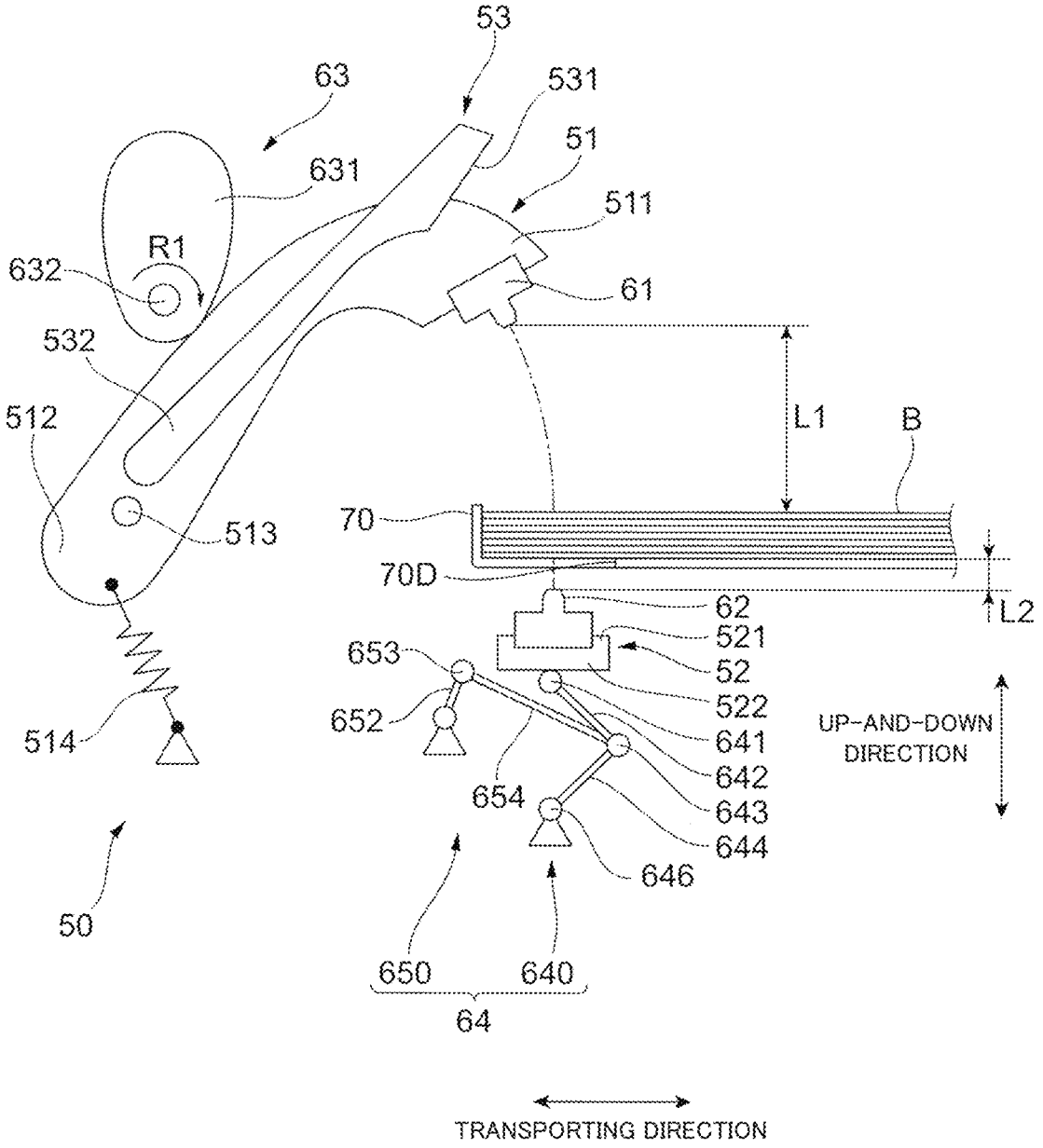
FIG. 13 illustrates a configuration and an initial state of the binding unit to which the exemplary embodiment is applied.

First, a structure of the binding unit 50 will be described with reference to FIG. 13. FIG. 13 illustrates a configuration and an initial state of the binding unit 50 to which the exemplary embodiment is applied.

In the following description, the thickness direction of the bundle of paper B illustrated in FIG. 12 will be simply described as "up-and-down direction", and the transporting direction of the transported bundle of paper B will be simply described as "transporting direction".

As illustrated in FIG. 13, the binding unit 50 to which the exemplary embodiment is applied includes upper teeth 61 that function as a first pressing unit and lower teeth 62 that confront the upper teeth 61 and function as a second pressing unit, both of which come into contact with the bundle of paper B to bind the bundle of paper B without a needle. The binding unit 50 includes an upper teeth supporting unit 51 that movably supports the upper teeth 61, a lower teeth supporting unit 52 that movably supports the lower teeth 62, and a paper pushing unit 53 that functions as pushing unit pushing the bundle of paper B with the paper collecting unit 70 from above the bundle of paper B placed on the stand (paper collecting unit 70). The binding unit 50 further includes an upper driving unit 63 that drives the upper teeth supporting unit 51 and the paper pushing unit 53 in a rotational motion and a lower driving unit 64 that drives the lower teeth supporting unit 52 in a linear motion.

Although the upper teeth 61 are set as the first pressing unit and the lower teeth 62 is set as the second pressing unit in the above description for convenience of description, the first pressing unit and the second pressing unit can also be interpreted as units including the upper teeth supporting unit 51 supporting the upper teeth 61 and the lower teeth supporting unit 52 supporting the lower teeth 62 respectively.

In the exemplary embodiment, the upper teeth 61 that come into contact with the bundle of paper B from one direction to bind the bundle of paper B without a needle and the lower teeth 62 that confront the upper teeth 61 and press the bundle of paper B from the other direction with respect to the one direction to bind the bundle of paper B without a needle are disposed such that the bundle of paper B (or the paper collecting unit 70) placed on the paper collecting unit 70 is sandwiched therebetween. Specifically, the upper teeth 61 and the upper teeth supporting unit 51 are disposed above the paper collecting unit 70, that is, on the side of the bundle of paper B with respect to the paper collecting unit 70. In addition, the lower teeth 62 and the lower teeth supporting unit 52 are disposed below the paper collecting unit 70. The paper pushing unit 53 is disposed above the paper collecting unit 70 and close to the upper teeth supporting unit 51.

In the exemplary embodiment, the upper teeth supporting unit 51 and the paper pushing unit 53 are formed to move independently of the lower teeth supporting unit 52. On the other hand, the paper pushing unit 53 is configured to be in tandem with the upper teeth supporting unit 51 by a connecting mechanism (not illustrated).

The upper teeth supporting unit 51 is an arm-shaped member, and has a one end portion 511 having the upper teeth 61 and the other end portion 512 extending from the one end portion 511 to one direction. The other end portion 512 is provided with a rotation shaft 513. The upper teeth 61 and the one end portion 511 are formed so as to be rotatable about the rotation shaft 513. In addition, the upper teeth supporting unit 51 includes a spring member 514 that applies a biasing force to the upper teeth supporting unit 51 counterclockwise in FIG. 13 in order to keep, at all times, an upper surface of the upper teeth supporting unit 51 in contact with a cam 631 to be described later.

The paper pushing unit 53 includes one end portion 531 that pushes the bundle of paper B placed on the paper collecting unit 70 and the other end portion 532 that extends from the one end portion 531 in one direction. The other end portion 532 is provided with an interlocking mechanism (not illustrated) that allows the paper pushing unit 53 to move in tandem with the upper teeth supporting unit 51. As an interlocking mechanism, there is a structure that allows the paper pushing unit to move in tandem with the movement of the upper teeth supporting unit 51, for example, by using a long hole and a pin, but details thereof are omitted herein. In addition, although not illustrated, the paper pushing unit 53 is configured of a U-shaped member with the upper teeth supporting unit 51 sandwiched therein in a horizontal direction orthogonal to each of the up-and-down direction and the transporting direction. The upper teeth 61 supported by the one end portion 511 press the bundle of paper B in a state where both sides of the bundle of paper B in the horizontal direction are pushed by the one end portion 531 of the paper pushing unit 53 formed in the U-shape.

The upper driving unit 63 that drives the upper teeth supporting unit 51 and the paper pushing unit 53 is a so-called cam-lever mechanism, and has the cam 631 formed of, for example, a plate cam and a rotation shaft 632, which is a rotation center of the cam 631.

The cam 631 presses the upper teeth supporting unit 51 from above the upper teeth supporting unit 51. By the rotation shaft 632 receiving a driving force from a motor (not illustrated) and the cam 631 rotating in an R1 direction illustrated in FIG. 13, the upper teeth supporting unit 51 moves from above the paper collecting unit 70 to the bundle of paper B. The movement amount of the upper teeth 61 at this time is set as L1 in the exemplary embodiment.

The lower teeth supporting unit 52 is a block-shaped member, and has an upper end portion 521 on which the lower teeth 62 are provided and a lower end portion 522 that comes into contact with a lower driving unit to be described later.

The lower driving unit 64 that drives the lower teeth supporting unit 52 is provided on a lower end portion 522 side of the lower teeth supporting unit 52. The lower driving unit 64 functions as a so-called jack mechanism that pushes out the lower teeth 62 functioning as a second pressing unit toward the bundle of paper B. Since the lower teeth 62 presses the bundle of paper B as the jack mechanism, a pressing force is large compared to the upper teeth 61 (functioning as a first pressing unit) in which the jack mechanism is not used. The lower driving unit 64 moves the lower teeth 62 supported by the lower teeth supporting unit 52 in the up-and-down direction, and the movement amount of the lower teeth 62 with respect to the position of the bundle of paper B placed on the paper collecting unit 70 is set as L2 in the exemplary embodiment. In the exemplary embodiment, the movement amount L2 of the lower teeth 62 is small compared to the movement amount L1 of the upper teeth 61 described above.

The lower driving unit 64 includes a link mechanism 640 and a crank mechanism 650 that operates the link mechanism 640. The link mechanism 640 and the crank mechanism 650 are connected to each other by a connection node 643.

The link mechanism 640 is a dogleg link, and includes a first connecting rod 642, a second connecting rod 644, and the connection node 643 that connects the first connecting rod 642 to the second connecting rod 644. In the "dogleg link" used herein, when the lower teeth 62 are displaced toward the upper teeth 61 to the maximum, the first connecting rod 642 and the second connecting rod 644, which configure the link, are not in a straight line. Accordingly, a defect in which the link is locked is solved by being in a straight line.

One end of each of the first connecting rod 642 and the second connecting rod 644 is connected to the connection node 643, and the other end of each of the first connecting rod and the second connecting rod is rotatably connected to an upper node 641 and a lower node 646 respectively. The upper node 641 is disposed to be movable to a position substantially vertically lower than a portion where the lower teeth 62 is present, and the lower node 646 is disposed in a state of being fixed to the lower side of the upper node 641.

The crank mechanism 650 includes a motor (not illustrated), which is a driving source, a crank rotating rod 652 which rotates by the driving of the motor, and a crank connecting rod 654 that moves by the rotation of the crank rotating rod 652. One end of the crank rotating rod 652 is mounted on a rotation shaft of the motor, and the other end is connected to the crank connecting rod 654 by a rotation node 653. The crank connecting rod 654 is connected to the crank rotating rod 652 via the connection node 643.

The crank mechanism 650 converts a rotational motion of the crank rotating rod 652 into the reciprocation (linear motion) of the connection node 643 via the crank connecting rod 654. By the connection node 643 reciprocating, the upper node 641 is moved in the up-and-down direction. As described above, since the upper node 641 is disposed at the position substantially vertically lower than the portion where the lower teeth 62 is present, the upper node 641 moves upwards, and thus the lower teeth 62 can press the bundle of paper B from below.

<Operation of Binding Unit 50>

Next, the operation of the binding unit 50 to which the exemplary embodiment is applied will be described in detail with reference to FIGS. 13 to 15.

Figure 14A:
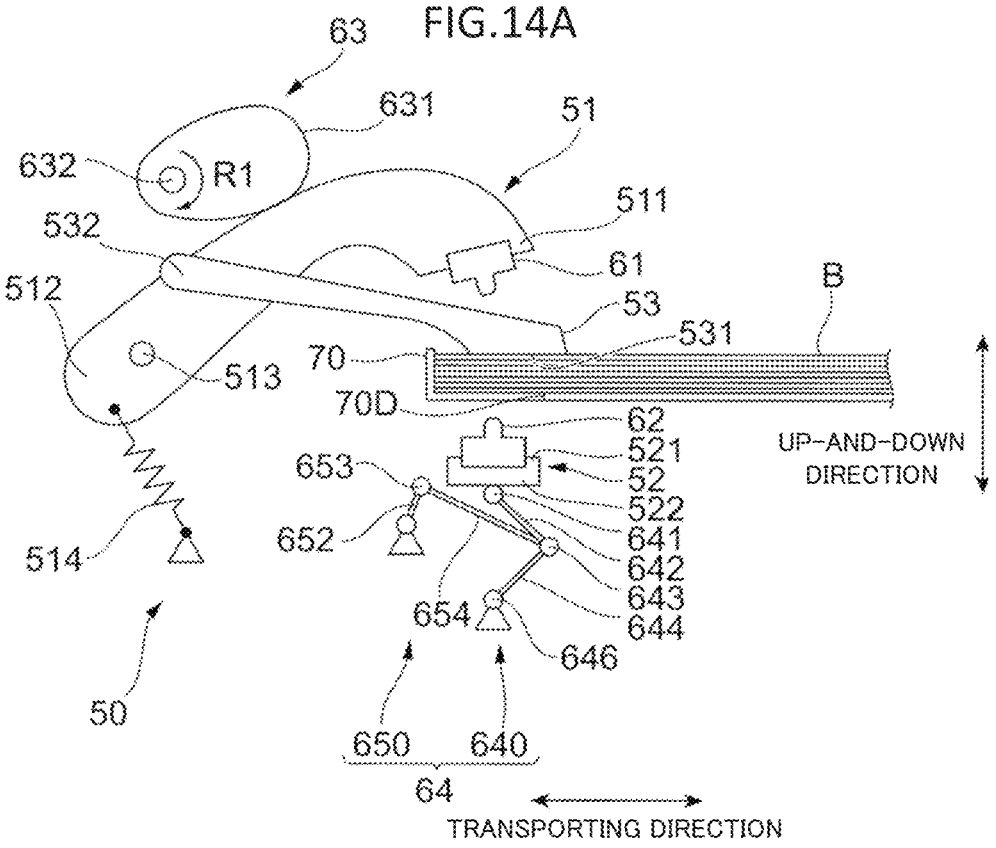
FIGS. 14A and 14B illustrate movement of an upper driving unit of the binding unit to which the exemplary embodiment is applied.
Figure 14B:
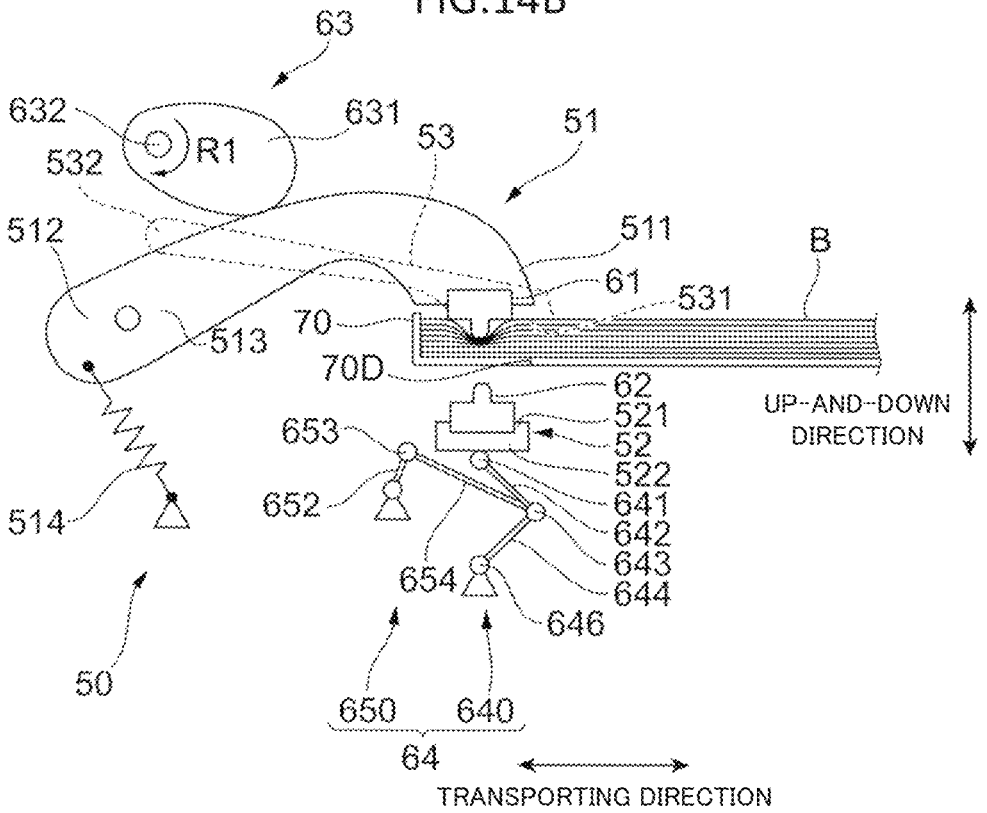

Herein, FIGS. 14A and 14B illustrate the movement of the upper driving unit 63 of the binding unit 50 to which the exemplary embodiment is applied. FIG. 14A illustrates a state where the paper pushing unit 53 pushes the bundle of paper B, and FIG. 14B illustrates a state where the upper teeth 61 are in contact with the bundle of paper B.

Figure 15:
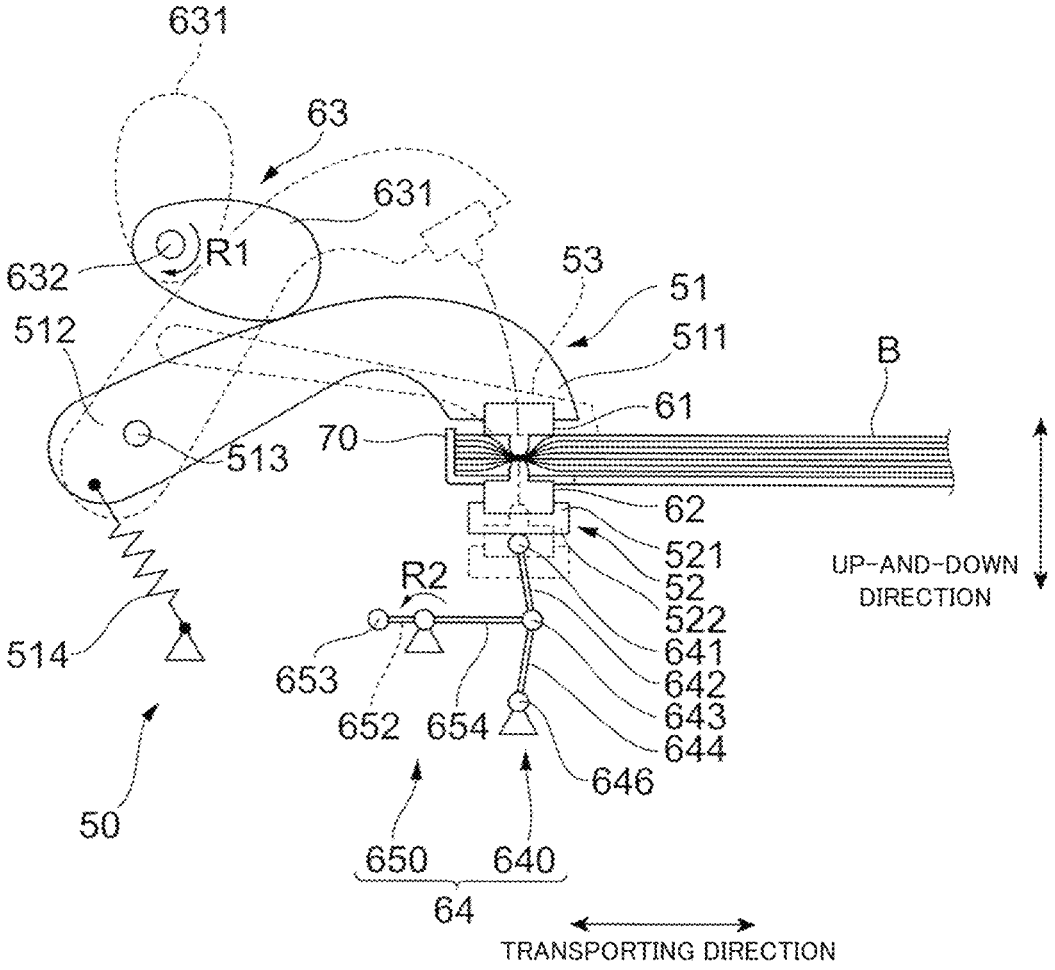
FIG. 15 illustrates movement of a lower driving unit of the binding unit to which the exemplary embodiment is applied and binding operation.

In addition, FIG. 15 illustrates the movement of the lower driving unit 64 of the binding unit 50 to which the exemplary embodiment is applied and binding operation.

The operation of the binding unit 50 is performed by operation by the upper driving unit 63 and operation by the lower driving unit 64 under the control of the paper processing control section 23 (refer to FIG. 11). In the exemplary embodiment, at the time of binding operation, first, operation by the upper driving unit 63 is performed. At that time, the lower driving unit 64 stands by. After the operation by the upper driving unit 63 is performed, the upper driving unit 63 stands by when operation by the lower driving unit 64 is performed. That is, operation by the upper driving unit 63 is performed first, and after then, operation by the lower driving unit 64 is performed. By operating in such a manner, a more stable binding can be realized. Operation by the upper driving unit 63 and operation by the lower driving unit 64 may be configured to be simultaneously performed.

First, the operation of the upper teeth supporting unit 51 (or the upper teeth 61) and the paper pushing unit 53 enabled by the upper driving unit 63 will be described with reference to FIGS. 13, and 14A and 14B.

The cam 631 rotates clockwise as the rotation shaft 632 rotates in the R1 direction. By this rotation, the upper teeth 61 move from an initial state to the bundle of paper B (downwards).

Herein, the initial state is a state before the start of operation, is a state where the upper teeth 61 and the lower teeth 62 are separated away from each other, and is a state where the binding portion is open in order to dispose the bundle of paper B at the binding position. More specifically, the initial state is a state where the upper teeth 61 or the lower teeth 62 are separated away from the bundle of paper B placed on the paper collecting unit 70 and are not in contact with the bundle of paper before being driven and moved by the upper driving unit 63 or the lower driving unit 64. In the exemplary embodiment, since the upper teeth 61 are disposed above the paper collecting unit 70, that is, closer to the bundle of paper B than to the paper collecting unit 70, the size of an opening can be adjusted according to the thickness of the bundle of paper B. In the case of adjusting in such a manner, the position of the upper teeth 61 in an initial state is changed. On the other hand, since the lower teeth 62 are disposed below the paper collecting unit 70, an effect of a change in the thickness of the bundle of paper B is not received, and thus it is rarely necessary to change the position of the lower teeth 62 in an initial state.

In the exemplary embodiment, a configuration where L1 shown in FIG. 13, that is, the movement amount L1 from the position of the upper teeth 61 in an initial state to the position of the bundle of paper B is changed by changing a rotation position (initial rotation position) of the cam 631 in an initial state, and the movement amount L2 from the position of the lower teeth 62 in an initial state to the position of the bundle of paper B does not change is adopted. A change in the movement amount L1 of the upper teeth 61 will be described later.

FIG. 13 illustrates a state where the upper teeth supporting unit 51 is in contact with a cam trough portion of the cam 631 when the cam 631 starts rotating from the initial state. At this time, the upper teeth supporting unit 51 and the paper pushing unit 53 are positioned at places separated away from the paper collecting unit 70 (or the bundle of paper B placed on the paper collecting unit 70).

After then, by the rotation of the cam 631, the position of the upper teeth supporting unit 51 (or the upper teeth 61) transitions to a state illustrated in FIG. 14A. At this time, as illustrated in FIG. 14A, the upper teeth supporting unit 51 is pressed by an intermediate portion between the cam trough portion and the cam peak portion of the cam 631, and makes a rotational motion downwards from the upper side of the paper collecting unit 70 with the rotation shaft 513 as a rotation center, that is, toward the paper collecting unit 70 (or the bundle of paper B).

At this time, the paper pushing unit 53 moves from the upper side of the paper collecting unit 70 to the bundle of paper B in tandem with the rotation of the upper teeth supporting unit 51. The one end portion 531 of the paper pushing unit 53 comes into contact with the bundle of paper B placed on the paper collecting unit 70 earlier than the upper teeth 61 supported by the upper teeth supporting unit 51, pushing the bundle of paper B from the upper side of the bundle of paper B to the paper collecting unit 70. At this time, the upper teeth 61 are yet to be in contact with the bundle of paper B, as illustrated in FIG. 14A. In addition, after coming into contact with the bundle of paper B, the paper pushing unit 53 does not separate away from an upper surface until binding operation is completed.

Next, by the rotation of the cam 631, the position of the upper teeth supporting unit 51 (or the upper teeth 61) transitions to a state illustrated in FIG. 14B. At this time, as illustrated in FIG. 14B, the cam peak portion of the cam 631 further presses the upper teeth supporting unit 51 downwards, and the upper teeth 61 supported by the upper teeth supporting unit 51 come into contact with the bundle of paper B.

After the upper teeth 61 have come into contact with the bundle of paper B, the output of the motor stops and the rotation of the cam 631 stops. Thus, the upper teeth 61 are brought into a standby state. Herein, the standby state is a state where after the upper teeth 61 have come into contact with the bundle of paper B placed on the paper collecting unit 70, the upper teeth are stopped at that position. In addition, the upper teeth 61 (or the upper teeth supporting unit 51) do not move until binding operation is completed after coming into contact with the bundle of paper B.

Next, the operation of the lower teeth supporting unit 52 (or the lower teeth 62) performed by the lower driving unit 64 will be described with reference to FIGS. 14B and 15.

After the upper teeth 61 are brought into a standby state, the motor (not illustrated), which is the driving source of the lower driving unit 64, starts rotating. By the driving force of the motor, the crank rotating rod 652 rotates from the state of FIG. 14B counterclockwise (R2 direction illustrated in FIG. 15). By the counterclockwise rotation of the crank rotating rod 652, the crank connecting rod 654 pulls the connection node 643 in a downstream side direction of the transporting direction, and the connection node 643 moves in a direction (hereinafter, referred to as "connection node moving direction") having both components of the downstream side direction and an upward direction of the transporting direction. As a consequence, the first connecting rod 642 and the second connecting rod 644 are brought into a state of being bent but almost linear as illustrated in FIG. 15 from a bent state ("dogleg" state) illustrated in FIG. 5B. At this time, since the position of the lower node 646, which is a node of the second connecting rod 644, is fixed, when the connection node 643 moves in the connection node moving direction, the upper node 641 moves upwards, the lower teeth supporting unit 52 is lifted, the lower teeth 62 are pushed out from below the paper collecting unit 70 to the bundle of paper B, and the bundle of paper B is pressed by the upper teeth 61 and the lower teeth 62.

By transitioning from the state of FIG. 13 to the state of FIG. 15 via the states of FIGS. 14A and 14B, first, the upper teeth 61 come into contact with the bundle of paper B from above by the upper driving unit 63 having the cam 631. After then, the lower teeth 62 are pushed out by the lower driving unit 64 having the link mechanism 640, which is the jack mechanism, to come into contact with the bundle of paper B from below, the bundle of paper B is sandwiched and pressed between the upper teeth 61 and the lower teeth 62 as illustrated in FIG. 15, and thus the bundle of paper B is bound. After binding operation with respect to the bundle of paper B is completed in such a manner, the motors of the upper driving unit 63 and the lower driving unit 64 reversely rotate. Then, pressing between the upper teeth 61 and the lower teeth 62 is released, and the upper teeth 61 and the lower teeth 62 return to an initial state illustrated in FIG. 13.

As described with reference to FIG. 13, the movement amount L2 of the lower teeth 62 is small compared to the movement amount L1 of the upper teeth 61 with respect to the position of the bundle of paper B placed on the paper collecting unit 70. As described above, although the jack mechanism used as the link mechanism 640 is adopted in the lower driving unit 64 in the exemplary embodiment, the movement amount L2 of the lower teeth 62 is small compared to the movement amount L1 of the upper teeth 61 by the cam-lever mechanism since the lower teeth 62 performing pressing with the jack mechanism. On the other hand, the pressing force of the lower teeth 62 generated by the jack mechanism can be made large compared to the pressing force of the upper teeth 61 generated by the cam-lever mechanism. By making the movement amount of the lower teeth 62 having a larger pressing force smaller than the movement amount of the upper teeth 61 having a smaller pressing force, the output of the driving source can be reduced compared to a case where a pressing force is increased to make the movement amount larger, and thus an increase in the size of the apparatus can be suppressed.

As described above, by making the movement amount L1 of the upper teeth 61 larger in the exemplary embodiment, an opening sufficient for disposing the bundle of paper B at the binding position is obtained, and thus it is possible to respond to a case where the number of sheets of the paper P has become larger and the thickness of the bundle of paper B has increased. Since a problem of an increase in the thickness of the bundle of paper B and making the opening larger can be solved by increasing the movement amount of the upper teeth 61 having a smaller pressing force, an increase in the size of the entire binding unit 50 can be suppressed. For example, even in a case where the binding unit 50 is intended to be used at the same place in the finisher unit 22, in which the stapler device with a needle is used, by replacing a stapler device with a needle, the stapler device with a needle of the related art can be replaced since the miniaturization of the entire binding unit 50 can be realized in the exemplary embodiment.

Next, a change in the movement amount L1 of the upper teeth 61 will be described.

The movement amount L1 of the upper teeth 61 can be controlled based on paper information including information of the bundle of paper B or information of the paper P configuring the bundle of paper B. Herein, the paper information refers to information related to the paper P or the bundle of paper B that affects the effectiveness of binding processing such as the thickness of the entire bundle of paper B, the number of sheets of the paper P configuring the bundle of paper B, and the type of the paper P (for example, paper quality such as whether it is a cardboard, thin paper, plain paper, or coated paper, surface properties, and the amount of moisture). The paper processing control section 23 recognizes the paper information, controls the rotation amount of the cam 631 driven by the upper driving unit 63 based on the recognition results, and determines the initial position of the upper teeth 61 supported by the upper teeth supporting unit 51. The following is given as a specific example of the control. In a case where the number of sheets of the paper P has become a small number to a large number, or a case where the paper P configuring the bundle of paper B is a cardboard not thin paper, the thickness of the bundle of paper B becomes larger. Thus, the initial position of the upper teeth 61 rises, and as a result, the movement amount L1 of the upper teeth 61 becomes larger.

In the exemplary embodiment, the movement amount L2 of the lower teeth 62 does not change. Even in a case where the thickness of the bundle of paper B has changed, it is not necessary to change the movement amount L2 of the lower teeth 62 pressing the bundle of paper B from below the paper collecting unit 70 since the position at which the bundle of paper B comes into contact with the paper collecting unit 70 does not change.

Modification Example

Although the upper driving unit 63 has adopted a so-called cam-lever mechanism and the lower driving unit 64 has adopted a so-called jack mechanism in the exemplary embodiment described above, other moving mechanisms may be used.

Although it is described that the upper teeth 61 and the lower teeth 62 are disposed in the up-and-down direction such that the bundle of paper B placed on the paper collecting unit 70, which is placed in the substantially horizontal direction, is sandwiched therebetween in the exemplary embodiment described above, there is a form in which the upper teeth 61 and the lower teeth 62 are disposed such that initial positions thereof are oblique, or a case where a moving direction of the upper teeth 61 and the lower teeth 62 is an oblique direction not a vertical direction with the paper collecting unit 70 being inclined obliquely.

In addition, although it is described that the paper pushing unit 53 is configured to be in tandem with the upper teeth supporting unit 51 in the exemplary embodiment described above, the paper pushing unit may be configured to move without being in tandem with the upper teeth supporting unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding member comprising:

an upper tooth that has an upper tooth form for forming unevenness in a bundle of recording materials; and a lower tooth that has a lower tooth form for forming unevenness in the bundle of recording materials and that forms a pair with the upper tooth, wherein at least one of the upper tooth form and the lower tooth form is formed such that, in a sectional shape, a groove is formed in a trough portion of a concave portion of a tooth form and a length of an inclined portion which comes into contact with the bundle of recording materials is made small compared to a case where the inclined portion of the tooth form has reached a bottom of the trough portion, and an angle of at least one side surface of the groove with respect to the advancing/retracting direction is smaller than an angle of the inclined portion with respect to the advancing/retracting direction.

2. The binding member according to claim 1, wherein a width of the groove at a connected portion at which the groove is connected to the inclined portion is larger than a width of the groove at the bottom.

3. The binding member according to claim 1, wherein when the upper tooth is meshed with the lower tooth without the bundle of recording materials being sandwiched therebetween, a region where the inclined portion of the tooth form, which forms the concave portion, is in contact with the inclined portion of the tooth form, which forms a convex portion confronting the concave portion, is generated.

4. The binding member according to claim 3, wherein the inclined portion of the tooth form, which forms the concave portion, is planarly in contact with the inclined portion of the tooth form, which forms the convex portion confronting the concave portion.

5. The binding member according to claim 3, wherein each of the upper tooth and the lower tooth has the groove formed in the concave portion of the tooth form.

6. The binding member according to claim 1, wherein the groove comprises a notch in the trough portion.

7. A binding member comprising:

an upper tooth that has an upper tooth form for forming unevenness in a bundle of recording materials; and a lower tooth that has a lower tooth form for forming unevenness in the bundle of recording materials and that forms a pair with the upper tooth, wherein at least one of the upper tooth form and the lower tooth form is formed such that, in a sectional shape, a groove is formed in a trough portion of a concave portion of a tooth form and a length of an inclined portion which comes into contact with the bundle of recording materials is made small compared to a case where the inclined portion of the tooth form has reached a bottom of the trough portion, wherein at least any one of the upper tooth and the lower tooth performs binding processing with respect to the bundle of recording materials by moving in an advancing/retracting direction determined in advance, the width of the groove at connected portion is larger than the width of the groove at the bottom by at least one side surface having an angle with respect to the advancing/retracting direction and being inclined with respect to the advancing/retracting direction, out of two side surfaces of the groove that are positioned on both sides of the groove, and a width of the groove at a connected portion at which the groove is connected to the inclined portion is larger than a width of the groove at the bottom.

8. The binding member according to claim 7, wherein the angle of at least the one side surface with respect to the advancing/retracting direction is smaller than an angle of the inclined portion with respect to the advancing/retracting direction.

9. The binding member according to claim 7, wherein the groove is formed in multiple stages, and at least the one side surface is provided with at least a first surface that has a large angle with respect to the advancing/retracting direction and faces the groove and a second surface that is positioned closer to the bottom than the first surface is and has a smaller angle with respect to the advancing/retracting direction than the angle of the first surface.

10. A binding member comprising:

an upper tooth that has an upper tooth form for forming unevenness in a bundle of recording materials; and a lower tooth that has a lower tooth form for forming unevenness in the bundle of recording materials and forms a pair with the upper tooth, wherein at least any one of the upper tooth form and the lower tooth form performs binding processing with respect to the bundle of recording materials by moving in an advancing/retracting direction determined in advance, and in a sectional shape, inclined portions, each of which has an angle with respect to the advancing/retracting direction and is inclined with respect to the advancing/retracting direction, are present, and the bundle of recording materials first comes into contact with an inclined portion having a larger angle with respect to the advancing/retracting direction.

11. The binding member according to claim 10, wherein a length of the inclined portion that first comes into contact with the bundle of recording materials is smaller than lengths of any other inclined portions.

* * * * *